US008719997B1

(12) United States Patent
Nathenson et al.

(10) Patent No.: US 8,719,997 B1
(45) Date of Patent: May 13, 2014

(54) PASS-THROUGH VACUUM

(75) Inventors: Richard D. Nathenson, Pittsburgh, PA (US); Mark W. Yorns, Longmeadow, MA (US)

(73) Assignee: Guardair Corporation, Chicopee, MA (US)

( * ) Notice: Subject to any disclaimer, the term of this patent is extended or adjusted under 35 U.S.C. 154(b) by 356 days.

(21) Appl. No.: 13/036,271

(22) Filed: Feb. 28, 2011

Related U.S. Application Data

(60) Provisional application No. 61/308,644, filed on Feb. 26, 2010.

(51) Int. Cl.
*A47L 5/00* (2006.01)
*A47L 9/02* (2006.01)
*B08B 5/00* (2006.01)

(52) U.S. Cl.
USPC ..... 15/300.1; 15/414

(58) Field of Classification Search
USPC ..... 15/300.1, 409, 414, 418; 37/322, 321, 37/317, 195
See application file for complete search history.

(56) References Cited

U.S. PATENT DOCUMENTS 4,240,173 A * 12/1980 Sherrill ..... 15/1.7
4,409,746 A * 10/1983 Beck ..... 37/317
4,449,862 A * 5/1984 Beck ..... 406/93
4,776,731 A * 10/1988 Briggs et al. ..... 406/153
4,936,031 A 6/1990 Briggs et al.
4,991,321 A * 2/1991 Artzberger ..... 37/309
5,140,759 A 8/1992 Artzberger
5,782,414 A 7/1998 Nathenson
5,966,847 A 10/1999 Nathenson et al.
6,058,630 A * 5/2000 Brown ..... 37/322
6,158,152 A 12/2000 Nathenson et al.
6,691,436 B2 * 2/2004 Chizek, Sr. ..... 37/322
7,676,965 B1 3/2010 Nathenson et al.

OTHER PUBLICATIONS

Vaccon Company, Inc., Material Conveying Vacuum Pumps: DF Series, Vaccon Vacuum Products Master Catalog, Aug. 22, 2007, pp. 221-232.
Vaccon Company, Inc., Operating Instructions for DF Series Material Transfer Pumps, Apr. 4, 2006, 4 pgs.

* cited by examiner

*Primary Examiner* — Dung Van Nguyen
(74) *Attorney, Agent, or Firm* — The Webb Law Firm

(57) ABSTRACT

A pass-through vacuum includes a mixing tube and separate and removable housing extending along a mutual central longitudinal axis. The housing contains at least one location for retaining a nozzle which extends along a nozzle axis and has an inlet configured to be in fluid communication with a compressed gas source and an outlet in fluid communication with the hollow interior of the mixing tube via an aperture. The nozzle axis of the nozzle extends at an acute angle with respect to the central longitudinal axis of the mixing tube. The at least one nozzle accelerates gas from the compressed gas source to create an improved performance to entrain gas and material to flowing through the mixing tube from the entrance end to the exit end. The mixing tube and the housing can each be independently configured to optimize their function and performance.

53 Claims, 33 Drawing Sheets

PASS-THROUGH VACUUM

CROSS REFERENCE TO RELATED APPLICATIONS

This application claims priority to U.S. Provisional Application No. 61/308,644 filed on Feb. 26, 2010, the entire contents of which are herein incorporated by reference.

BACKGROUND OF THE INVENTION

1. Field of the Invention

The invention relates to an improved pass-through vacuum and vacuum system, wherein a multiplicity of supersonic jets of compressed gas are utilized to increase their performance and to the unique construction of the vacuum which increases the flexibility of their use.

2. Description of Related Art

Systems that blow compressed air along the inside of a pipe or tube to create a simple vacuum are well known. Suction is created at the entrance of the tube suitable for entraining a solid or liquid material. On the discharge end of the tube, a hose may be connected for directing the material safely to a desired location. An extension hose or tube may be attached to the inlet section of the tube to increase the reach of the unit.

Being light in weight, low in cost, vibration free, and powered by a readily available portable air compressor, a pass-through vacuum offers advantages over standard, industrial vacuum units or trucks using a roots blower or centrifugal fan.

However, many prior art systems have disadvantages as well. In the simplest construction, the air pipe itself may block part of the vacuum tube limiting the size of material that may be conveyed. Inefficient means may also be used to convert the energy of the input compressed air into vacuum head to move the material. Such is the case, for example, for vacuum models which use simple sharp, edged holes as acceleration nozzles. Many compressed air amplifiers are also commercially marketed. However, these generally are for moving high volumes of air and, as such, produce low heads not suitable for moving difficult to convey materials like excavated soil.

Further, prior art systems utilize a single-piece injection unit for both the injection of compressed gas into the system and the conveyance of material through the system. This causes a great deal of wear on the injection unit since flowable material conveyed through the injection unit by the entrained gas flow will continually pit and scratch the interior of the injection unit during use. Consequently, the injector units do not have a particularly long service life in comparison to their relatively high cost. Further, prior art injection units do not have the capability of selecting the number of nozzles that inject compressed gas into the system. Thus, individual injector units may not be suitable for use with a large variety of compressors or in many different projects.

SUMMARY OF THE INVENTION

Accordingly, there is a general need in the art for an improved air powered, pass-through vacuum that is highly portable, flexible, hand-held, and that operates with readily available compressed air sources, such as conventional portable air compressors or even for a limited time from a high pressure bottle cascade with a suitable high flow regulator, while generating sufficient suction to quickly clear an excavation site, keyhole, utility valve box or other area of spoil or like flowable material.

The disclosed pass-through vacuum provides improvements over the current state of the art. Unique flexibility in the construction of the apparatus is provided to readily change the tube if it suffers wear or to meet specific needs according to the character of the material being conveyed. By separating the vacuum head and mixing tube, each can independently be constructed of different materials to optimize each ones performance and cost. Operational flexibility is provided to readily change the amount of compressed air utilized to tailor the unit for particular applications and to match various sizes of portable air compressors. Performance may be enhanced by using one or more, properly designed supersonic air jets to fully convert the energy of the compressed air.

The improved pass-through vacuum described herein may be used to: remove spoil from a pot-hole or pit during normal excavation; clean out utility valve boxes; fill sandbags readily; or even more exotic uses such as to: remove soil from a victim in a trench collapse; uncover buried land mines or IED's; or suck up spilled crude oil.

According to a non-limiting embodiment, an air powered pass-through vacuum that is hand held is provided. The vacuum includes a short, thin wall metal tube into which a multiplicity of supersonic air jets is introduced. This tube section is also called the injector or mixing tube. The jets are inclined at a shallow angle to the longitudinal axis of the tube, for instance 5-20°. The jets are spaced, preferably but not necessarily equally, around the circumference of the tube. Air at an elevated pressure, for example 90 psig, from a suitable air compressed air source is provided to nozzles, which create these jets. The air flow may be controlled by the operator using a valve connected to the pass-through vacuum and to which a hose from the compressed air source connects with a standard coupling. The valve may be a ball type with a handle that will stay in an open or closed position on its own or may be of a squeeze, i.e. dead-man, type that must be held open continuously. Alternately, a foot valve arrangement may be employed to enable the operator to have both hands free. The nozzle may be adapted to convert the compressed air into a supersonic jet of air. For example, 90 psig, 100° F. compressed air can be fully expanded into a Mach 2, i.e., approximately 1700 feet per second, jet. Accelerated air from the jets mixes with air in the section of tube that follows the nozzle causing the air to increase in speed. The length of this mixing section, L, is preferably 7 to 8 times its diameter, D. Suction is therefore created at the entrance of the tube suitable for entraining flowable material, such as soil, which may have been loosened by an air or water digging tool. Such a digging tool is described in U.S. Pat. Nos. 5,966,847 and 6,158,152 to Nathenson et. al., which are hereby incorporated by reference as if set forth in their entireties herein. On the discharge end of the tube, a hose may be connected for directing the material safely to a desired location. A porous, such as burlap, bag may be disposed over the end of the tube or hose to collect material, but to let the entrained air pass-through. An extension hose or tube or the combination of them may be attached to the inlet section of the tube to allow the operator to conveniently stand while holding the mixing section at chest level and reach ground level or below ground level.

According to a first embodiment of the present invention, a pass-through vacuum system is provided. The pass-through vacuum system includes an inlet vacuum tube having an entrance end and an exit end, the entrance end of the inlet vacuum tube being configured to collect a flowable material; an air powered pass-through vacuum as will be described in further detail below is connected to the exit end of the inlet vacuum tube; and a flexible conduit connected to the exit end of the pass-through vacuum such that the inlet vacuum tube, pass through vacuum, and the flexible conduit are in mutual fluid communication. The system may also include a collector in fluid communication with the exit end of the flexible conduit, the collector being configured to receive the flowable material. The collector may be simply a flexible bag constructed to contain the entrained material yet let the entrained air escape or may be a rigid container or hopper designed to hold or further discharge the flowable material. According to another embodiment of the present invention, a pass-through vacuum system is provided where the positions of the pass-through vacuum and the flexible conduit are reversed.

According to a preferred but non-limiting embodiment, the pass-through vacuum is constructed with multiple locations for utilizing more than one supersonic nozzle. The multiple locations are connected by a manifold formed by a cavity in a machined or cast structure or constructed of a hollow pipe or tubing extending between each location.

According to another preferred but non-limiting embodiment, the machined or cast structure containing the manifold and multiple locations for the nozzles is separate from the mixing tube allowing each section to be made of a different material to optimize parameters such as weight, cost, and wear resistance. Being separate also allows ready replacement of the lower cost mixing tube when it wears out independently of the higher cost structure and nozzles.

According to an alternate non-limiting embodiment, the multiple locations are connected with pipe or tubing in a simple, but rugged construction. Each supersonic air jet nozzle is disposed in a section of heavy wall pipe. The inside of the heavy wall pipe is counter bored to create a shoulder against which the nozzle rests. The heavy wall pipe is cut at an acute angle and welded to the surface of an exterior tube fastened to the outside of the vacuum tube. An elliptical hole is cut into the main tube to mate with a cross-section of the heavy wall pipe. To achieve a superior and higher level of suction, the exit end of the supersonic nozzle should be disposed as closely as possible to the inside of the suction tube. The manifold can be composed of pipe or tube fittings if two supersonic nozzles are used. For more than two nozzles, the manifold may be constructed of pipe or tubing rolled and welded into a continuous ring.

According to a non-limiting embodiment, to facilitate use of the vacuum, one or more handles may be disposed along the circumference and length. In one of these locations, a hand operated lever valve may be located for controlling the flow of compressed air to the nozzles. If a circumferentially oriented pipe or tube manifold is used, the manifold may be covered by a thermally insulating, elastomeric material and also used as a handhold. The handles are also located at points to balance the weight for ease of use.

According to a non-limiting embodiment, the suction and nozzle tubes may be made of stainless steel for long life and low maintenance. The supersonic nozzles may be made of a readily machinable material such as brass. The valve, manifold, and piping may be made of a suitable material such as stainless steel or brass to be non-rusting. A label may be located on the outside of the vacuum detailing the compressed air requirements and any specific cautions in its use.

According to an embodiment of the present invention, a pass-through vacuum is provided. The vacuum includes a mixing tube extending along a central longitudinal axis between an entrance end and an exit end, the mixing tube including a tube wall having an inner cylindrical surface defining a hollow interior of the mixing tube and an outer surface defining a periphery of the mixing tube and at least one aperture extending through the tube wall from the outer surface to the inner cylindrical surface of the tube wall; a housing removably disposed on the periphery of the mixing tube and connected to the outer surface of the mixing tube by a connector; and at least one nozzle disposed within the housing, the at least one nozzle extending along a nozzle axis and having an inlet configured to be in fluid communication with a compressed gas source and an outlet in fluid communication with the hollow interior of the mixing tube via the at least one aperture in the mixing tube wall. The housing retains the at least one nozzle in close proximity to the periphery of the mixing tube and aligns the outlet of the at least one nozzle with the at least one aperture in the mixing tube wall. The nozzle axis of the at least one nozzle extends at an acute angle with respect to the central longitudinal axis of the mixing tube. The at least one nozzle is configured to accelerate gas from the compressed gas source as the gas enters the hollow interior of the mixing tube via the at least one nozzle and the aperture to create an entrained gas flow through the mixing tube from the entrance end to the exit end.

According to another embodiment of the present invention, a pass-through vacuum system is provided. The system includes an inlet vacuum tube having an entrance end and an exit end, the entrance end of the inlet vacuum tube being configured to collect a flowable material; and a pass-through vacuum. The pass-through vacuum includes a mixing tube extending along a central longitudinal axis between an entrance end and an exit end, the mixing tube including a tube wall having an inner cylindrical surface defining a hollow interior of the mixing tube and an outer surface defining a periphery of the mixing tube and at least one aperture extending through the tube wall from the outer surface to the inner cylindrical surface of the tube wall; a housing removably disposed on the periphery of the mixing tube and connected to the outer surface of the mixing tube by a connector; and at least one nozzle disposed within the housing, the at least one nozzle extending along a nozzle axis and having an inlet configured to be in fluid communication with a compressed gas source and an outlet in fluid communication with the hollow interior of the mixing tube via the at least one aperture in the mixing tube wall. The entrance end of the mixing tube is in fluid communication with the exit end of the inlet vacuum tube. The housing retains the at least one nozzle in close proximity to the periphery of the mixing tube and aligns the outlet of the at least one nozzle with the at least one aperture in the mixing tube wall. The nozzle axis of the at least one nozzle extends at an acute angle with respect to the central longitudinal axis of the mixing tube. The at least one nozzle is configured to accelerate gas from the compressed gas source as the gas enters the hollow interior of the mixing tube via the at least one nozzle and the aperture to create an entrained gas flow through the vacuum system from the entrance end of the inlet vacuum tube through the exit end of the mixing tube for entraining the flowable material proximate to the entrance end of the inlet vacuum tube.

According to a further embodiment of the present invention, a method of directing a flowable material is provided. The method includes the step of providing a pass-through vacuum system. The system includes an inlet vacuum tube having an entrance end and an exit end, the entrance end of the inlet vacuum tube being configured to collect a flowable material; and a pass-through vacuum. The pass-through vacuum includes a mixing tube extending along a central longitudinal axis between an entrance end and an exit end, the mixing tube including a tube wall having an inner cylindrical surface defining a hollow interior of the mixing tube and an outer surface defining a periphery of the mixing tube and at least one aperture extending through the tube wall from the outer surface to the inner cylindrical surface of the tube wall;

a housing removably disposed on the periphery of the mixing tube and connected to the outer surface of the mixing tube by a connector; and at least one nozzle disposed within the housing, the at least one nozzle extending along a nozzle axis and having an inlet configured to be in fluid communication with a compressed gas source and an outlet in fluid communication with the hollow interior of the mixing tube via the at least one aperture in the mixing tube wall. The entrance end of the mixing tube is in fluid communication with the exit end of the inlet vacuum tube. The housing retains the at least one nozzle in close proximity to the periphery of the mixing tube and aligns the outlet of the at least one nozzle with the at least one aperture in the mixing tube wall. The nozzle axis of the at least one nozzle extends at an acute angle with respect to the central longitudinal axis of the mixing tube. The method further includes the steps of directing compressed gas from the compressed gas source to the at least one nozzle; accelerating the compressed gas with the at least one nozzle as the gas enters the hollow interior of the mixing tube via the at least one nozzle and the aperture; creating an entrained gas flow through the vacuum system from the entrance end of the inlet vacuum tube through the exit end of the mixing tube; entraining the flowable material proximate to the entrance end of the inlet vacuum tube in the entrained air flow; and directing the flowable material out of the exit end of the mixing tube.

According to a still further embodiment of the present invention, a suction adapter disposed on an end of a vacuum tube for entraining liquid material in a gas flow is provided. The suction adapter includes an outer piece attached to the end of the vacuum tube; and an inner piece partially disposed within and connected to the outer piece such that an annular space is formed between the inner piece and the outer piece. The inner piece has a longer length and a smaller diameter than the outer piece. The outer piece and the inner piece are both in fluid communication with the end of the vacuum tube and gas may flow through the annular space between the inner piece and the outer piece while the inner piece is at least partially submerged in the liquid to entrain the liquid in the gas flow.

According to yet another embodiment of the present invention, a pass-through vacuum is provided. The vacuum includes a mixing tube extending along a central longitudinal axis between an entrance end and an exit end, the mixing tube including a tube wall having an inner cylindrical surface defining a hollow interior of the mixing tube and an outer surface defining a periphery of the mixing tube and a plurality of apertures extending through the tube wall from the outer surface to the inner cylindrical surface of the tube wall; a plurality of nozzles, each nozzle extending along a nozzle axis and having an inlet configured to be in fluid communication with a compressed gas source and an outlet in fluid communication with the hollow interior of the mixing tube via one of the plurality of apertures; a housing disposed on the periphery of the mixing tube and connected to the outer surface of the mixing tube, the housing including plurality of housing tubes for retaining the plurality of nozzles and a manifold having an inlet configured to be connected to the compressed gas source and a plurality of outlets in fluid communication with the plurality of housing tubes and the inlets of the nozzles; and a mechanism for selectively closing off flow of compressed gas from the manifold to the inlet of at least one of the plurality of nozzles. The housing retains the plurality of nozzles in close proximity to the periphery of the mixing tube and aligns the outlets of the nozzles with the apertures in the mixing tube wall. Each nozzle axis extends at an acute angle with respect to the central longitudinal axis of the mixing tube. The manifold is configured to direct compressed gas from the inlet of the manifold to the plurality of nozzles. The nozzles are configured to accelerate gas from the compressed gas source as the gas enters the hollow interior of the mixing tube via the nozzles and the apertures to create an entrained gas flow through the mixing tube from the entrance end to the exit end.

Further details and advantages of the invention will become clear upon reading the following detailed description in conjunction with the accompanying drawing figures, wherein like parts are designated with like reference numerals throughout.

DESCRIPTION OF THE PREFERRED EMBODIMENTS

Figure 1:
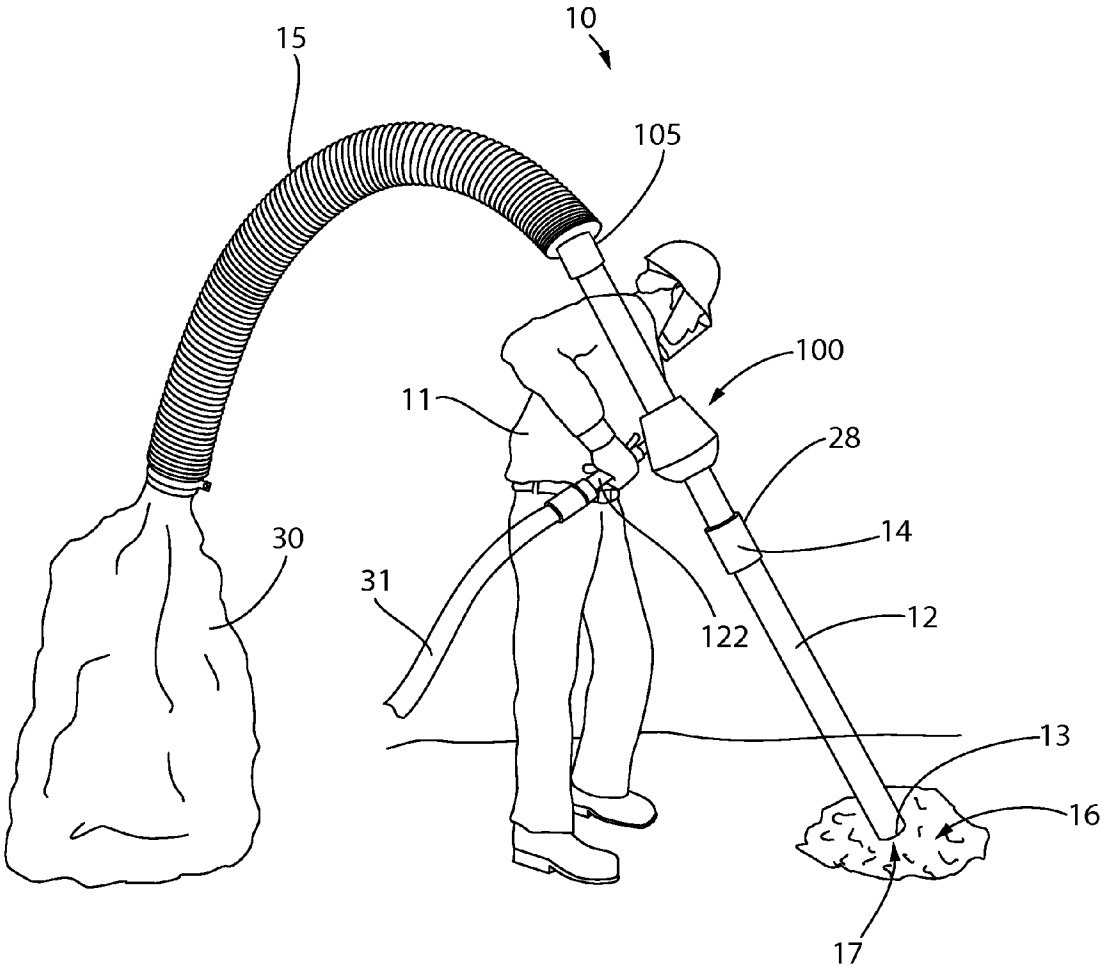
FIG. 1 is a schematic view of a pass-through vacuum system in accordance with an embodiment of the present invention.

For purposes of the description hereinafter, the terms "end", "upper", "lower", "right", "left", "vertical", "horizontal", "top", "bottom", "lateral", "longitudinal" and derivatives thereof shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting. Further, it is to be understood that the invention may assume various alternative variations and step sequences, except where expressly specified to the contrary.

It is to be understood that the terms "flowable material" and "spoil" can be used interchangeably and as used herein these terms encompass any type of material that is excavated and/or may be entrained in a flow of gas, air or the like. These materials may include dirt, soil, debris, sand, gravel, rocks, water, oil, and contaminants.

FIG. 1 illustrates an operator 11 using a pass-through vacuum system 10 to remove spoil from a subsurface location. With reference to FIG. 1, a pass-through vacuum system 10 in accordance with an embodiment of the present invention is depicted. The system includes a pass-through vacuum 100, which is powered by a flow of compressed air or other suitable gas and is held by a worker 11. An inlet vacuum tube 12 is attached to the front of the pass-through vacuum 100 by an inlet coupling 28. The inlet vacuum tube has an entrance end 13 and an exit end 14. The entrance end 13 is configured to collect a flowable material 16, such as spoil, via an entrained gas flow 17 entering the entrance end 13. A flexible conduit 15 is connected to the exit end 104 of the pass-through vacuum through a second metal coupling 105. The other end of flexible conduit 15 is connected to a discharge bag 30. The discharge bag 30 is of a nature to contain the flowable material 16 yet let the entrained gas 17 escape.

The inlet vacuum tube 12, pass-through vacuum 100, flexible conduit 15, and discharge bag 30 are in mutual fluid communication with each other. The inlet vacuum tube 12 and the flexible conduit 15 may be made from any suitable material known to those having ordinary skill in the art, including plastic materials. Additionally, the tube 12 and conduit 15 may be made of clear materials so that potential clogs may be seen. The operator 11 controls the flow of compressed air to the pass-through vacuum 100 via a hand operated valve 122. The valve 122 is connected via a hose 31 to a suitable air compressor 18 (not shown).

It is to be understood that various alternate combinations of the described parts are possible. For example, more than one inlet tube may be used, each of these being connected by a short section of flexible conduit 15. The discharge bag 30 may be also eliminated with the discharge end of the flexible conduit 15 secured in place and situated to blow the entrained material 16 safely onto a pile or into a separate container. Also, it is to be appreciated that the pass-through vacuum 100 may be effectively utilized with a flow of compressed air provided by a compressed air source, such as an air compressor, and with many different types of compressed gas provided by suitable sources.

Figure 2:
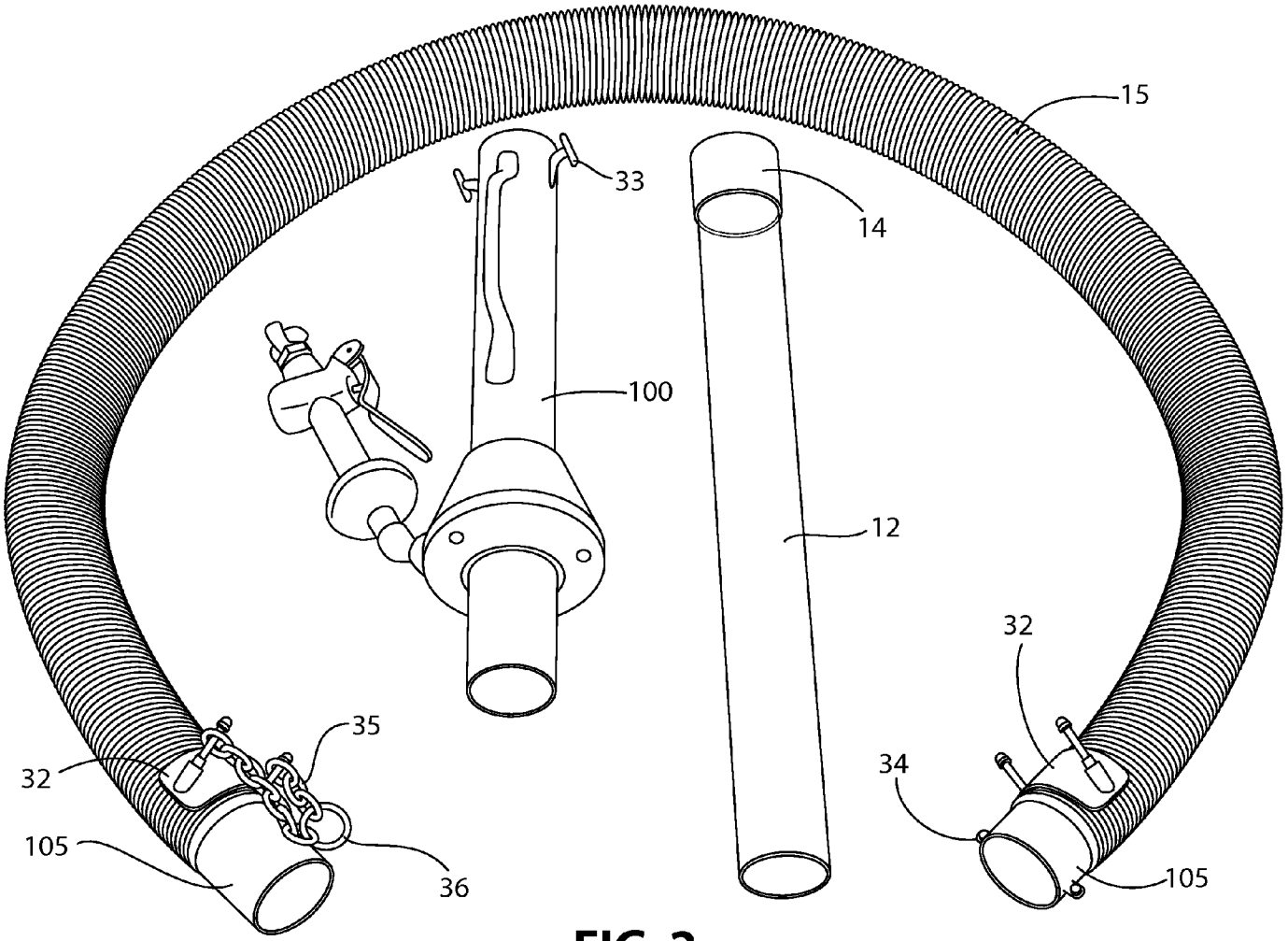
FIG. 2 illustrates specific components of the pass-through vacuum.

FIG. 2 shows additional details of the individual components of the pass-through vacuum system 10. The inlet vacuum tube 12 is typically a thin wall tube made of a lightweight plastic material. For additional benefit it may be made of a clear plastic such as acrylic to show any signs of clogging or Lexan for improved wear resistance. A thin wall metal coupling 14 is glued to the upper end of the inlet tube. Coupling 14 slips with a close fit over the inlet end 103 of the mixing tube 101 so that it stays in place when the vacuum is being handled, yet can be removed for transport, cleaning, or exchanging for another length. In operation, the suction will also tend to keep the inlet tube in place.

The flexible conduit 15 is typically a section of plastic or rubber hose rated for material handling and pneumatic service. It is generally ribbed on the outside for strength, but smooth on the inside to provide low friction to lower air head loss and to ease material transport. It may also be clear to spot any signs of clogging. Possible materials include polyurethane and PVC, the choice of the material also consistent with the chemical composition of the spoil. For some applications, a ground wire may be embedded in the hose to reduce static buildup. On the inlet end of the flexible conduit 15 a metal coupling 105 is installed. This coupling has an inlet section that slips with a close fit over the discharge end 104 of the mixing tube and an outlet end that fits tightly into the inlet end of the hose. For most applications, the mixing tube 101, the flexible conduit 15, and the inlet vacuum tube 12 should all have the same internal diameter such that the suction power created by the pass-through vacuum 100 is properly transmitted to the entrance end 13 of the inlet vacuum tube 12.

A mechanical hose coupling 32 is tightened with screws to additionally hold the hose onto the coupling. Multiple latches 33, such as a rubber T, are fixed to the outlet end of the mixing tube which fit into tabs 34 welded to the coupling to ensure the flexible conduit 15 stays connected to the mixing tube in operation. In operation the air and material exiting the mixing tube 101 could tend to blow off the hose if it is not tightly constrained in a positive, i.e. locking, fashion. The exit end of the hose may be fitted in various ways. FIG. 2 shows a second metal coupling 105 fixed to the hose with a clamp 32. A short section of metal chain 35 is also fixed to and between the two bolts holding on the clamp 32. A metal spring loaded hook or carabiner style latch 36 is provided for attaching the discharge end of the hose to prevent whipping in operation.

The pass-through vacuum 100 is pneumatically connected with the compressed air or gas source 18, which provides the vacuum 100 with a flow of compressed air or gas, as will be discussed in further detail below. The vacuum 100 includes at least one nozzle 112 (shown in FIG. 5) that is configured to accelerate compressed gas from the compressed gas source 18 as the gas enters the mixing tube 101 via the at least one nozzle 112 to create the entrained air flow 17 through the system 10 from the entrance end 13 of the inlet vacuum tube 12 through the flexible hose 15 and provide suction at the entrance end 13 of the inlet vacuum tube 12 for entraining the flowable material 16 located proximate to the entrance end 13 of the inlet vacuum tube 12.

Figure 3:
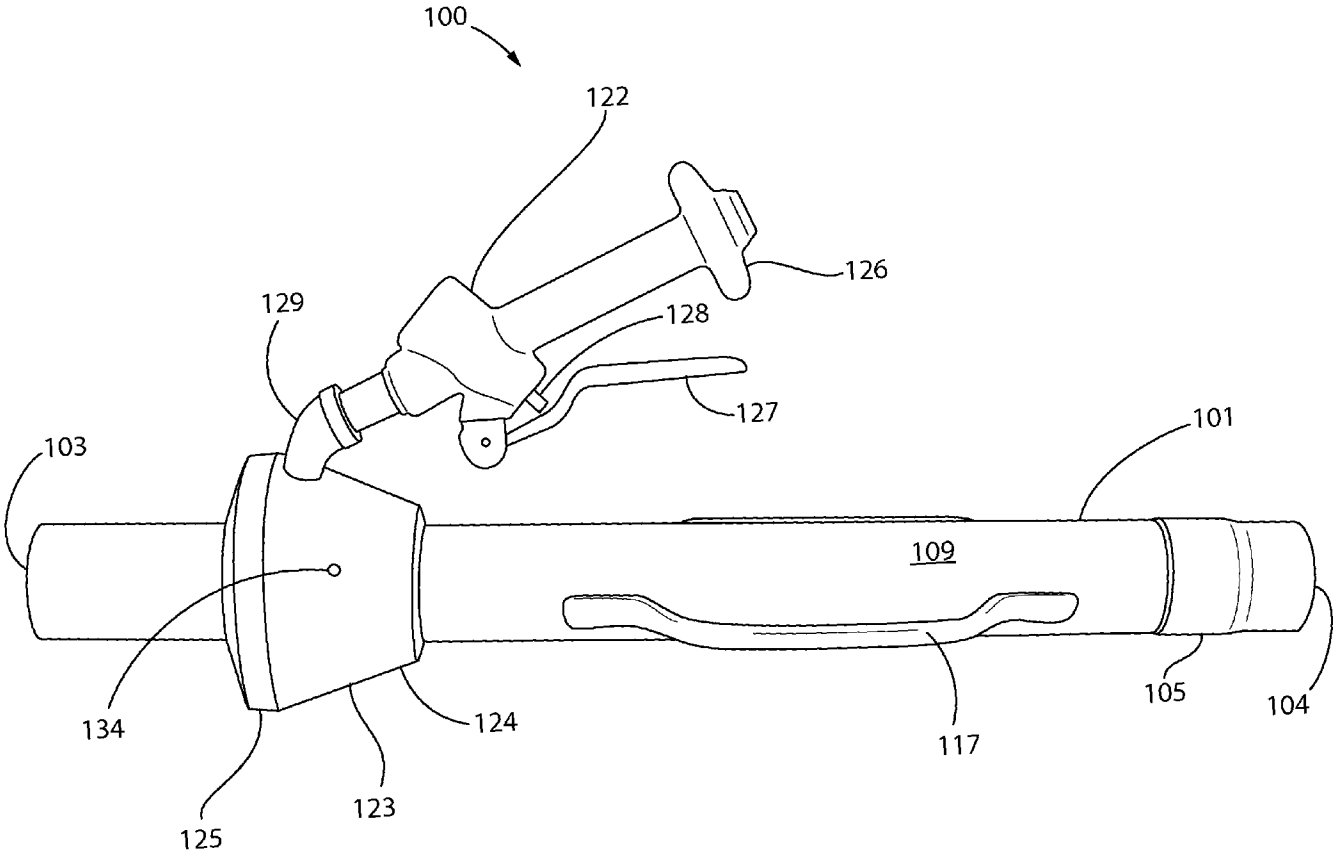
FIG. 3 is a perspective view of an air powered pass-through vacuum in accordance with an embodiment of the present invention.

With reference to FIGS. 3-10 a gas-powered pass-through vacuum 100 in accordance with an embodiment of the present invention is depicted. The vacuum 100 includes a mixing tube 101 that extends along a central longitudinal axis 102 between an entrance end 103 and an exit end 104. A fitting 28 or 105 may be provided on the ends 103, 104 of the mixing tube 101 for facilitating an attachment of the mixing tube 101 to a separate flexible conduit or a collector. The mixing tube 101 includes a tube wall 106 that has an inner cylindrical surface 107 that defines a hollow interior 108 of the mixing tube 101 and an outer surface 109 that defines a periphery of the mixing tube 101. At least one aperture 110 extends through the tube wall 106 from the outer surface 109 to the inner cylindrical surface 107 of the tube wall 106. As shown in FIG. 3, at least one handle 117 may be disposed on the outer surface 109 of the mixing tube 101 to facilitate handling of the vacuum 100.

Figure 6:
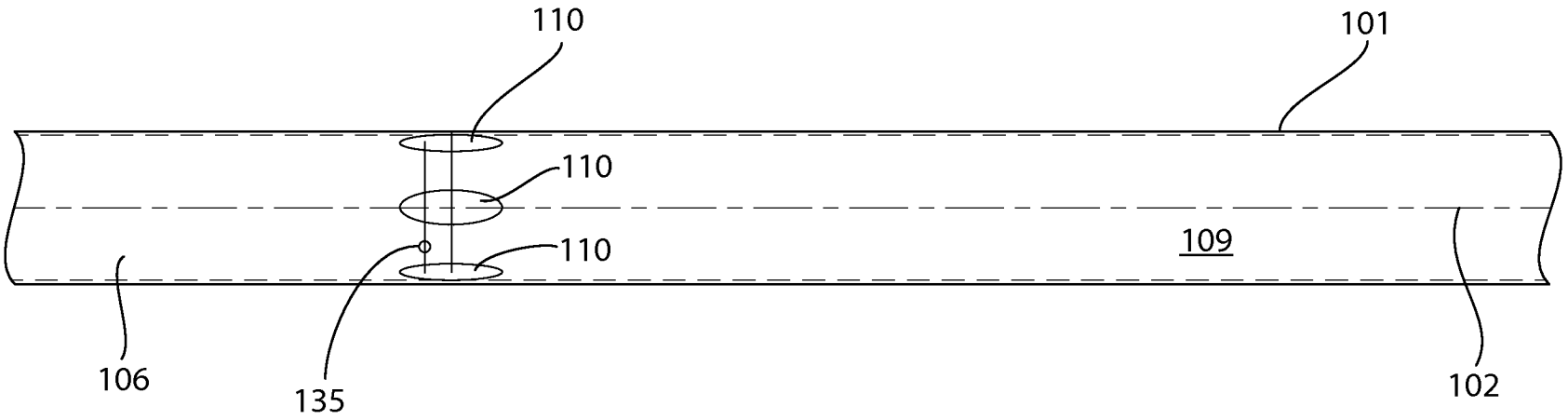
FIG. 6 is a side view of the mixing tube of the vacuum of FIG. 3.
Figure 26:
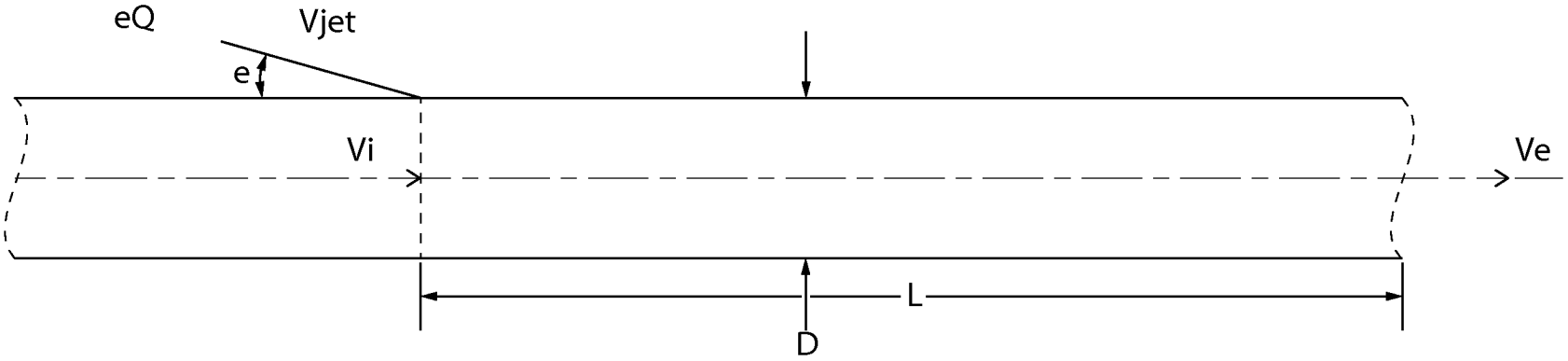
FIG. 26 is an illustration of the dimensions and flows of the mixing section.

With reference to FIGS. 6 and 26, the mixing tube 101 is typically dimensioned such that the ratio of the length L defined between the centerline of the apertures 110 and the exit end 104 to the inside diameter of the mixing tube 101 is 7 to 8. The apertures 110 are equally circumferentially spaced in the mixing tube 101. It is to be appreciated that the configuration of the mixing tube 101 may be altered to account for individual circumstances of production, compatibility with various nozzle housings and air compressors, and use in various projects. Accordingly, the relative dimensions of the mixing tube 101 and the spacing of the apertures 110 may be altered according to the skill and knowledge of one having ordinary skill in the art. The mixing tube 101 may be fabricated from any material known to be suitable to those having ordinary skill in the art, which exhibits sufficient strength with a relatively thin wall. Being separate from the vacuum head, the material for the mixing tube may be optimized for its own intended use such as: hardened carbon steel tubing, iron, polytetrafluoroethylene or UHMW plastic to be resistant to wear or to minimize friction; polyvinyl chloride, polyurethane, or fiberglass epoxy to be non-conducting; brass to be non-sparking; stainless steel or aluminum to be non-rusting; or aluminum or plastic to be light weight. Additionally, the mixing tube 101 may be made from a combination of the above materials, such as fiberglass epoxy and incorporate a non-stick lining, such as polytetrafluoroethylene.

Figure 5:
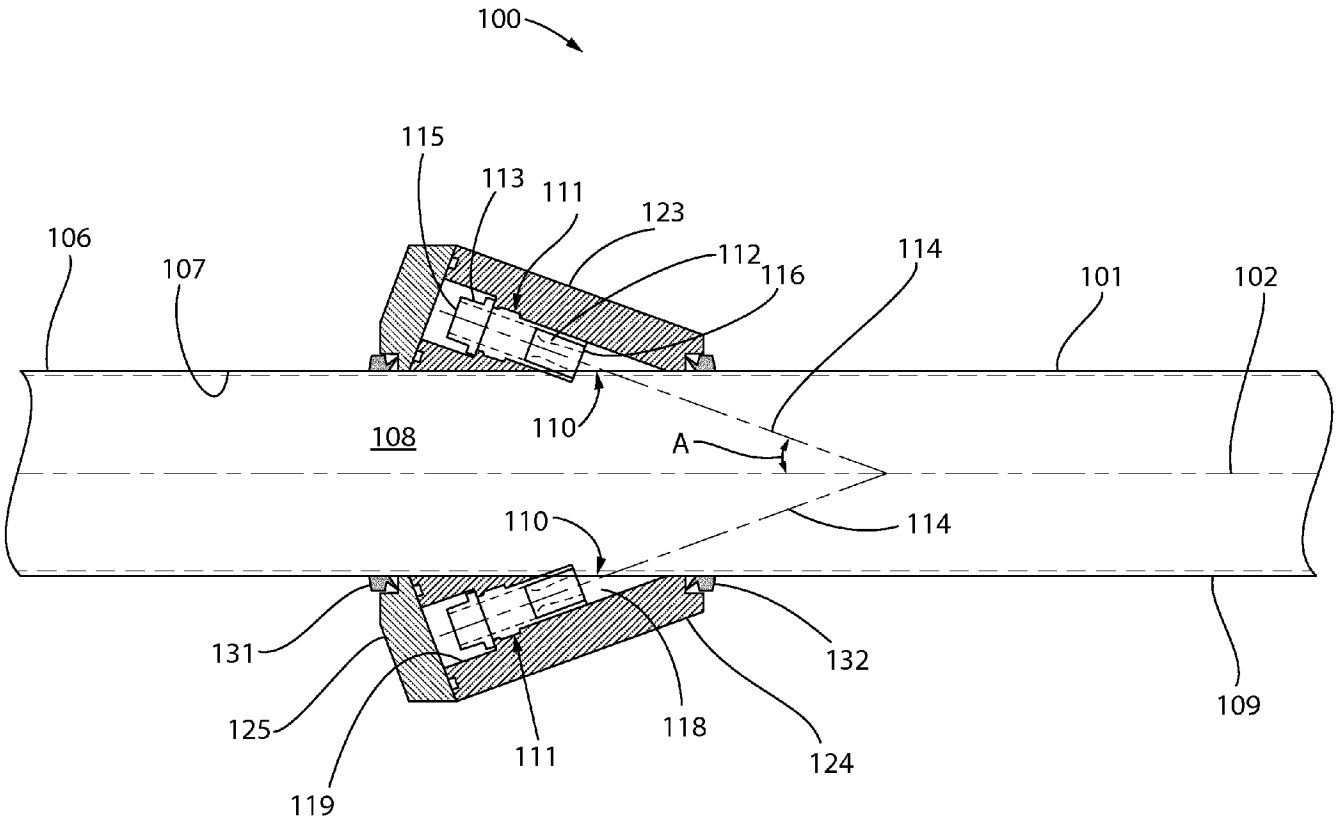
FIG. 5 is a cross-sectional side view of the vacuum head and mixing tube of the vacuum of FIG. 3.

As shown in FIG. 5, at least one nozzle assembly 111 is disposed on the periphery of the mixing tube 101 and extends along a nozzle axis 114. The nozzle assembly 111 has an inlet 115 that is configured to be in fluid communication with the compressed gas source 18 and an outlet 116 that is in fluid communication with the hollow interior 108 of the mixing tube 101 via the aperture 110 in the tube wall 106 of the mixing tube 101.

The nozzle assembly 111 is configured to accelerate gas from the compressed gas source 18 along its own axis 114 to enter the hollow interior 108 of the mixing tube 101 via the nozzle assembly 111 and the aperture 110 to create the entrained gas flow 17 through the mixing tube 101 from the entrance end 103 to the exit end 104 and provide suction at the entrance end 103 of the mixing tube 101. The nozzle axis 114 of the nozzle assembly 111 extends at an acute angle A with respect to the central longitudinal axis 102 of the mixing tube. It is to be appreciated that the acute angle A of the nozzle axis 114 may be of any value so long as it is sufficiently shallow to direct the accelerated gas into the hollow interior 108 such that the accelerated gas mixes with the gas within the mixing tube 101 to create the entrained gas flow 17. According to an embodiment of the present invention, the acute angle A is approximately within the range of 5°-20° with respect to the central longitudinal axis 102 of the mixing tube 101. According to a further embodiment of the present invention, the acute angle A is 20°.

Figure 5A:
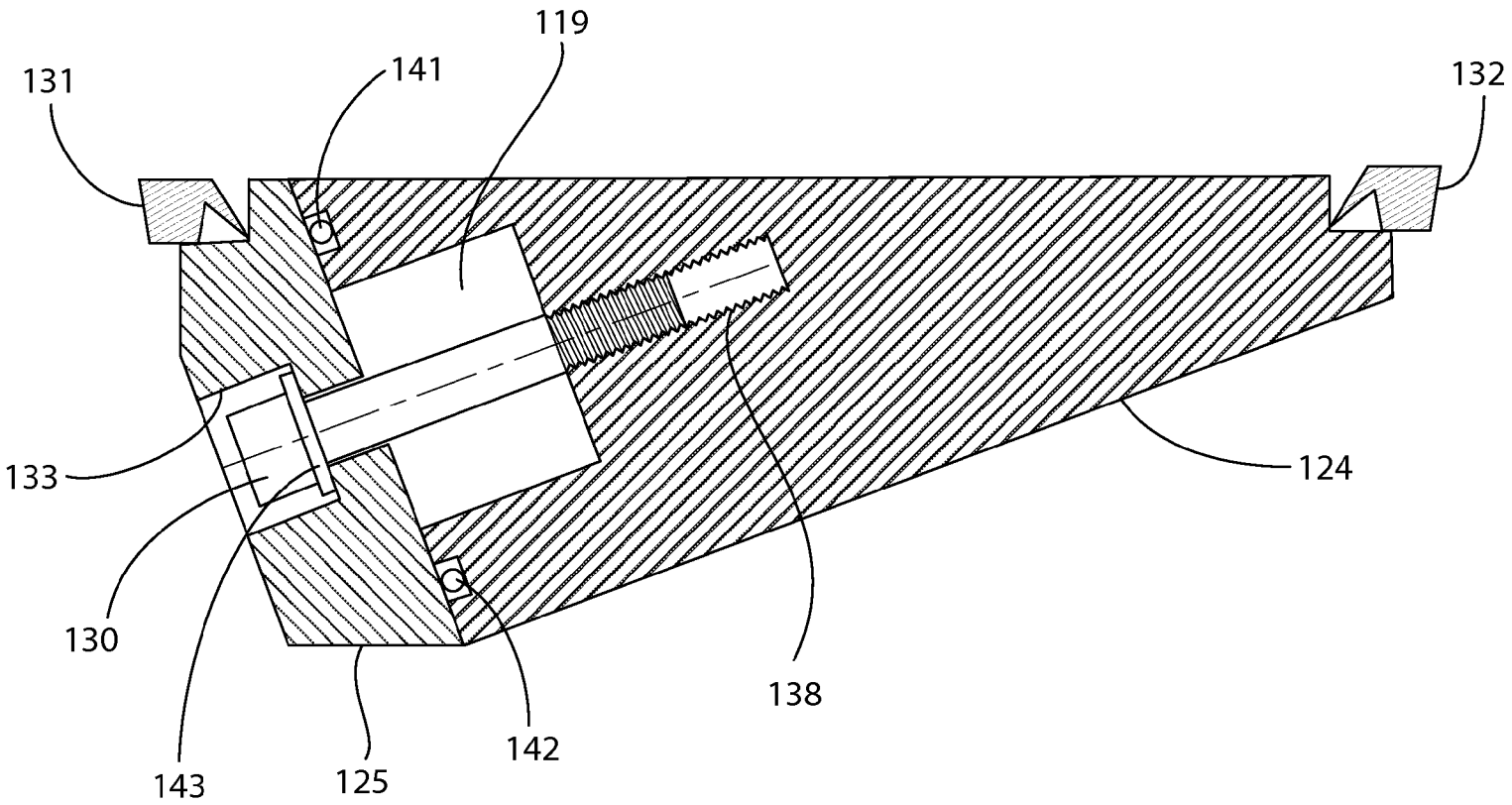
FIG. 5A is an alternate cross-sectional side view of a portion of the vacuum head of FIG. 5.
Figure 5B:
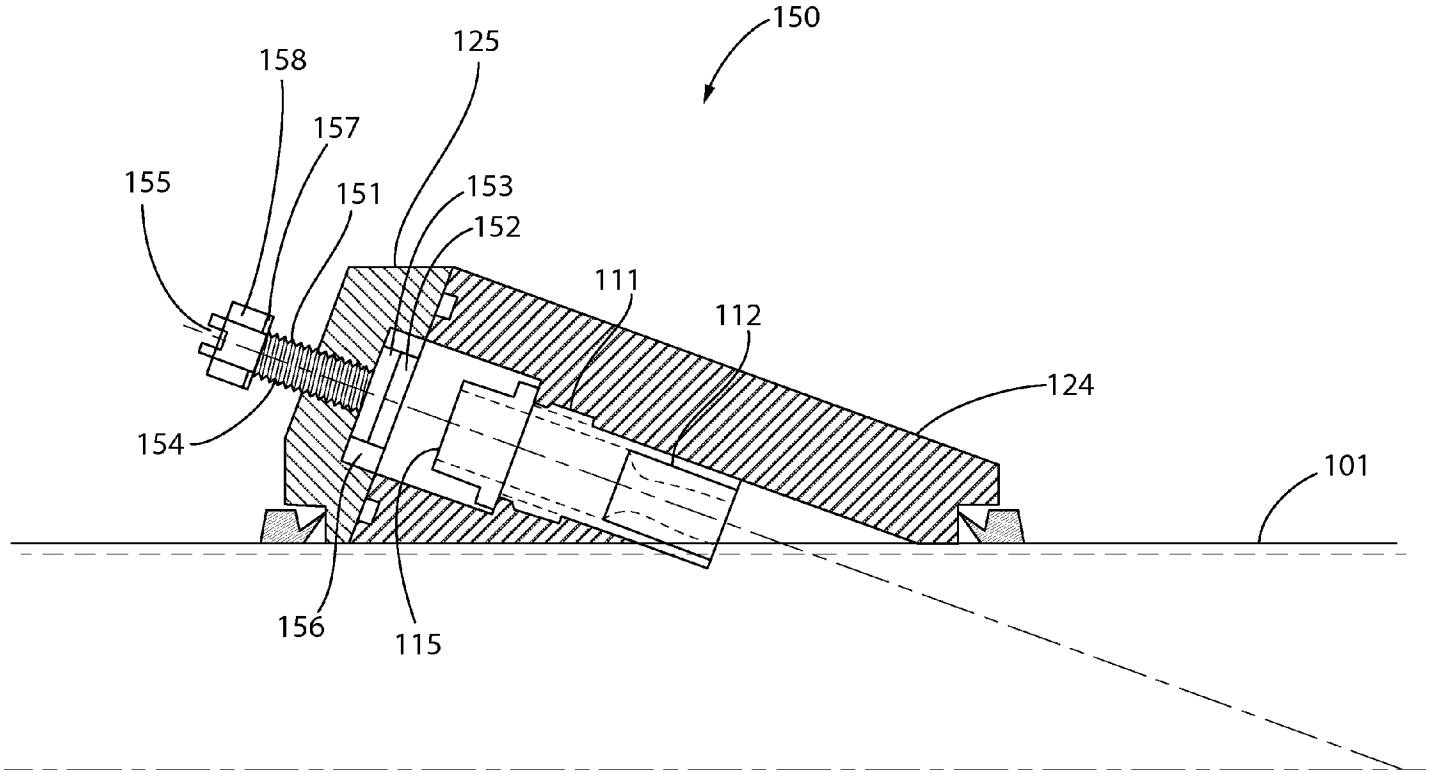
FIG. 5B is another alternate cross-sectional side view of a portion of the vacuum head of FIG. 5 according to a further embodiment of the present invention.
Figure 10:
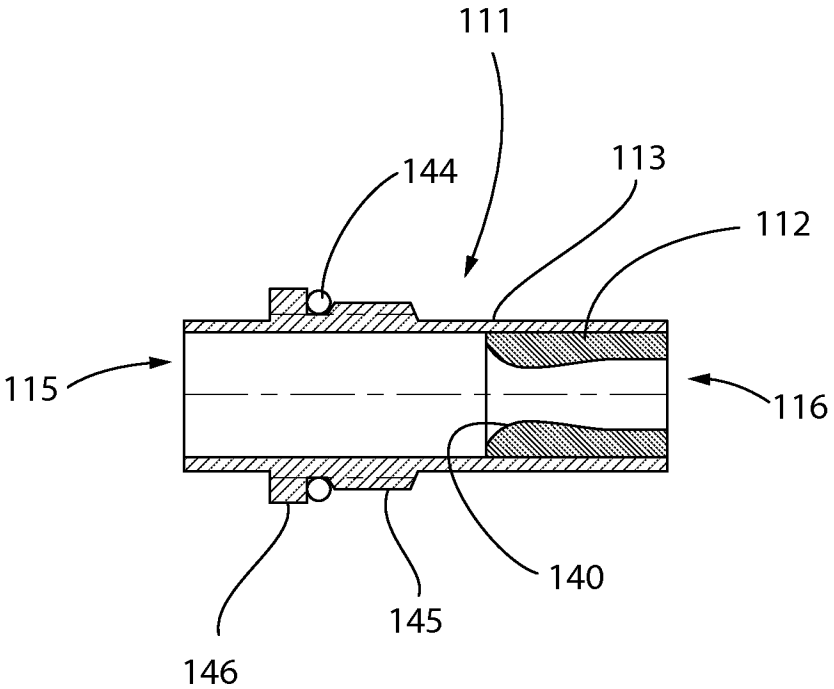
FIG. 10 is a cross-sectional side view of a supersonic nozzle and holder.

As shown in FIGS. 5, 5B, and 10, the nozzle assembly 111 includes a nozzle 112 and a nozzle holder 113 that are connected by any mechanism known to those having ordinary skill in the art. For instance, the nozzle 112 may fit on to an end of the nozzle holder 113 with an interference fit to provide a frictional engagement. The nozzle holder 113 defines the inlet 115 of the nozzle 112 and the nozzle 112 defines the outlet 116. The nozzle 112 includes a contoured interior surface 140 that accelerates compressed gas flowing through the nozzle 112. According to an embodiment of the present invention, the contoured surface 140 includes converging, expansion, and straightening portions defined by a simple combination of arcs and a line segment for the general purpose of producing a supersonic jet, as will be described in further detail below. The nozzle 112 may be fabricated from any material known to be suitable to those having ordinary skill in the art, such as brass, stainless steel, aluminum, plastic, or reinforced plastic.

Figure 4:
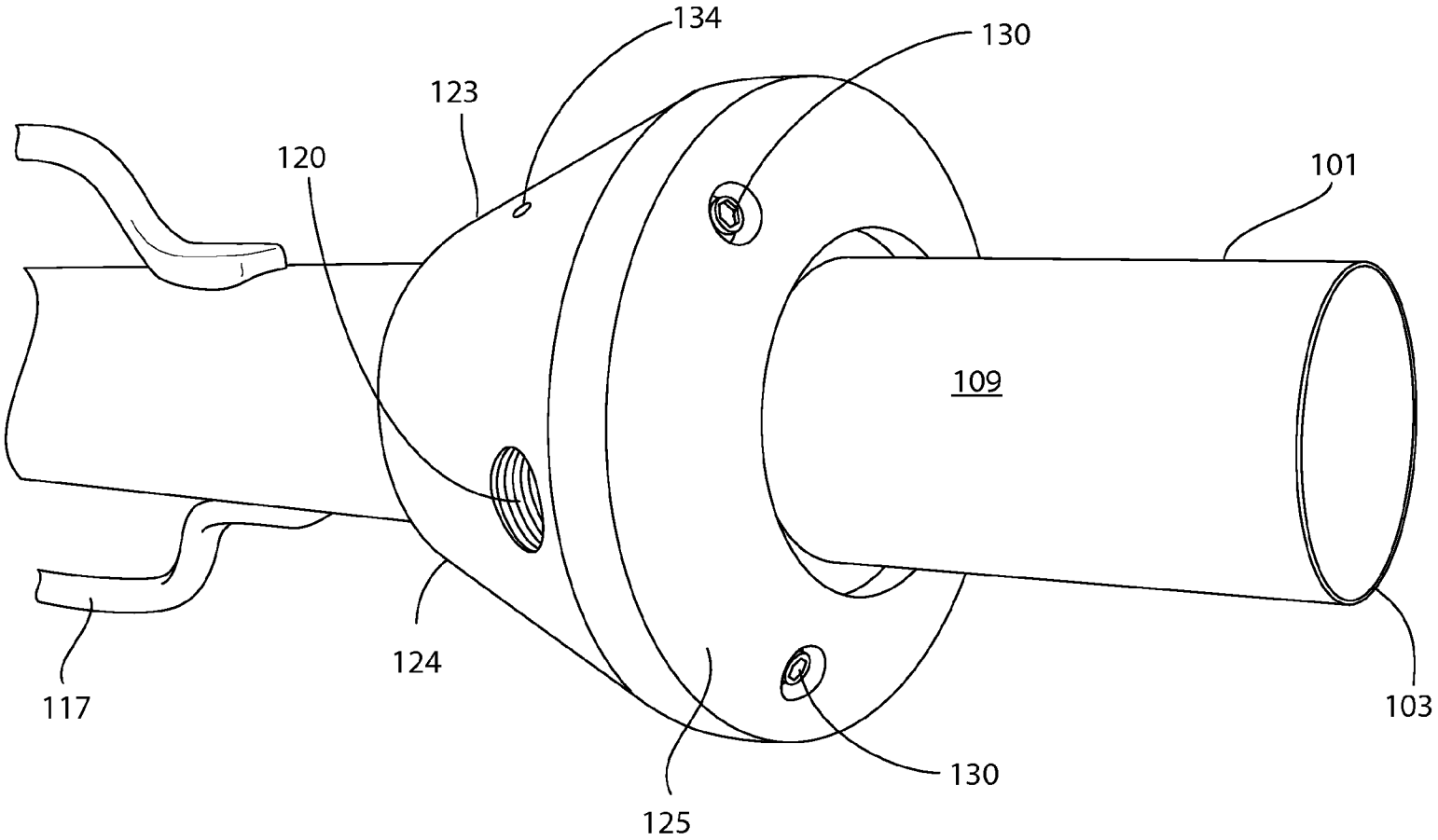
FIG. 4 is a detailed perspective view of a vacuum head and mixing tube of the vacuum of FIG. 3.

As shown in FIGS. 3-5, the vacuum 100 includes a vacuum head 123 attached to the outer surface 109 of the mixing tube 101. The vacuum head 123 houses a multiplicity of nozzles 112, typically from one to six, which are generally but not necessarily equally spaced, about the periphery of the mixing tube 101. The vacuum head includes a body 124 that extends around the periphery of the mixing tube 101. As shown in FIGS. 5, 5A, and 7A-7C, the vacuum head includes a plurality of housing tubes 118 defined therein, which hold the nozzles 112 in close proximity to the apertures 110 in the mixing tube 101 and align the outlets 116 of the nozzles 112 with the apertures 110. To that end, the housing tubes 118 are formed along the nozzle axis 114 and, as shown in FIG. 6, the apertures 110 may have an elliptical shape to accommodate the acute angle A of the housing tubes 118 and nozzles 112 extending at the acute angle A along the nozzle axis 114. As shown in FIGS. 5 and 10, the nozzles 112 may be fit into the housing tubes 118 by any suitable means such as a screw thread 145 and may seal using an O-ring 144 compressed between a shoulder 146 and a counterbore face 147 typical of an SAE O-ring boss design.

According to an embodiment of the present invention, the housing tubes 118 hold the nozzles 112 such that the outlets 116 of the nozzles 112 are spaced from the hollow interior 108 of the mixing tube 101 by a minimal distance and/or such that the outlets 116 of the nozzles 112 are at least partially disposed within the apertures 110 in the tube wall 106. Preferably, the outlets 116 are spaced from the hollow interior 108 at a distance no greater than 0.4 inches in prototype units that have been constructed and tested to date. However, it is to be appreciated that the minimal distance may be any distance that still allows for effective performance of the vacuum 100 and could be larger depending on the circumstances of manufacture and use.

The vacuum head 123 also includes a lid 125 extending around the periphery of the mixing tube 101. The lid 125 engages the body 124 to cover the housing tubes 118. The vacuum head 123 also includes an inlet 120 that is configured to be placed in fluid communication with the compressed gas source 18 such that compressed gas may enter the vacuum head 123. As shown in FIGS. 4 and 7A, the inlet 120 is defined within the body 124. The body 124 and the lid 125 further define a manifold cavity 119 in fluid communication between the inlet 120 of the vacuum head 123 and the inlets 115 of the nozzles 112. The manifold cavity 119 is configured to direct the compressed gas from the inlet 120 of the vacuum head 123 to the inlets 115 of the nozzles 112. To that end, the manifold cavity 119 may include a plurality of outlets 121 that are in fluid communication with the inlets 115 of the nozzles 112. Particularly as shown in FIGS. 5, 5A, and 7A-7C, the manifold cavity 119 is defined as a ring-shaped channel formed in the body 124 of the vacuum head 123, which is closed by the lid 125.

Fasteners 130 are provided for connecting the lid 125 to the body 124. The fasteners may be disposed within counter bored holes 133 in the lid 125 and extend through the manifold cavity 119 to engage in threaded holes 138 in the body 124, which are circumferentially interspersed with the housing tubes 118. Further, O-ring sealing elements 141 and 142 may be provided in channels 139 formed in the body 124 of the vacuum head 123 for sealing the engagement between the body 124 and the lid 125. A sealing washer 143 may be placed under the head of each fastener 130 to prevent leakage of compressed gas from chamber 119. The body 124 and the lid 125 of the vacuum head 123 may be machined components fabricated from any suitable material known to those having ordinary skill in the art, such as aluminum, which is light weight, low-cost, non-corrosive, and non-rusting or stainless steel for more rugged applications. As shown, the body 124 and the lid 125 are fabricated such that their contours are angled to correspond to the acute angle A of the nozzle axis 114.

Figure 7B:
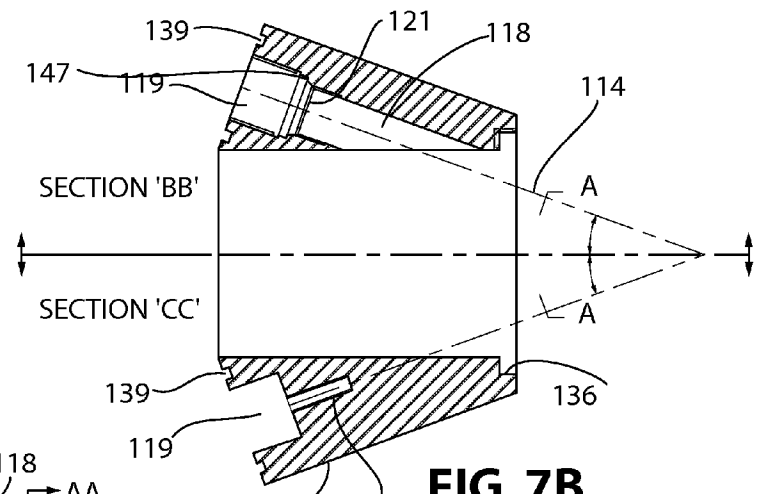
FIG. 7B is an alternate cross-sectional side view of the body of the vacuum head of FIG. 5 taken along lines "BB" and "CC" shown in FIG. 7C.
Figure 7A:
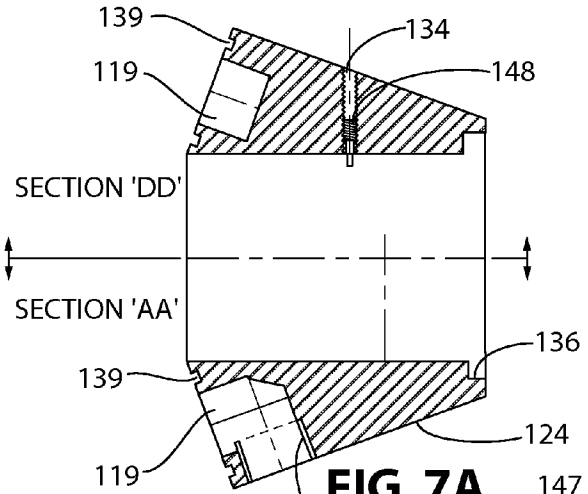
FIG. 7A is a cross-sectional side view of a body of the vacuum head of FIG. 5 taken along lines "AA" and "DD" shown in FIG. 7C.
Figure 7C:
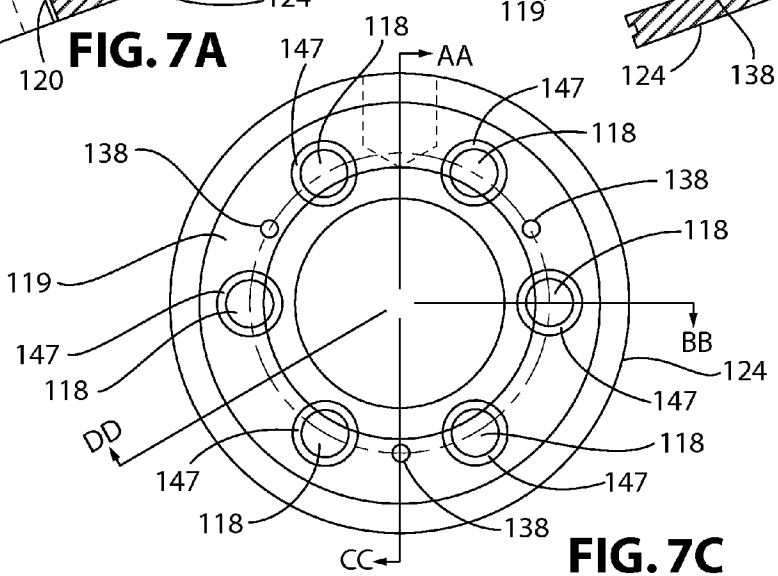
FIG. 7C is an end view of the body of the vacuum head of FIG. 5.
Figure 8:
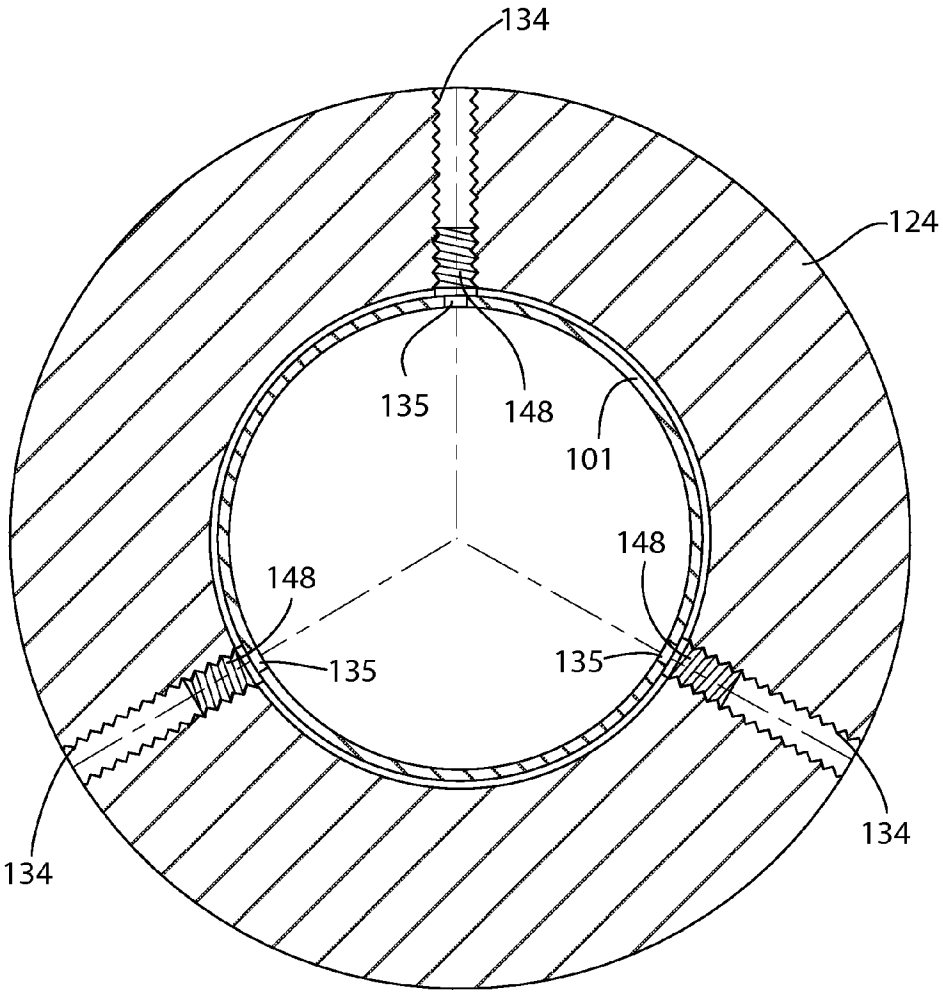
FIG. 8 is a longitudinal cross-sectional view of the vacuum head and mixing tube of FIG. 5.
Figure 9B:
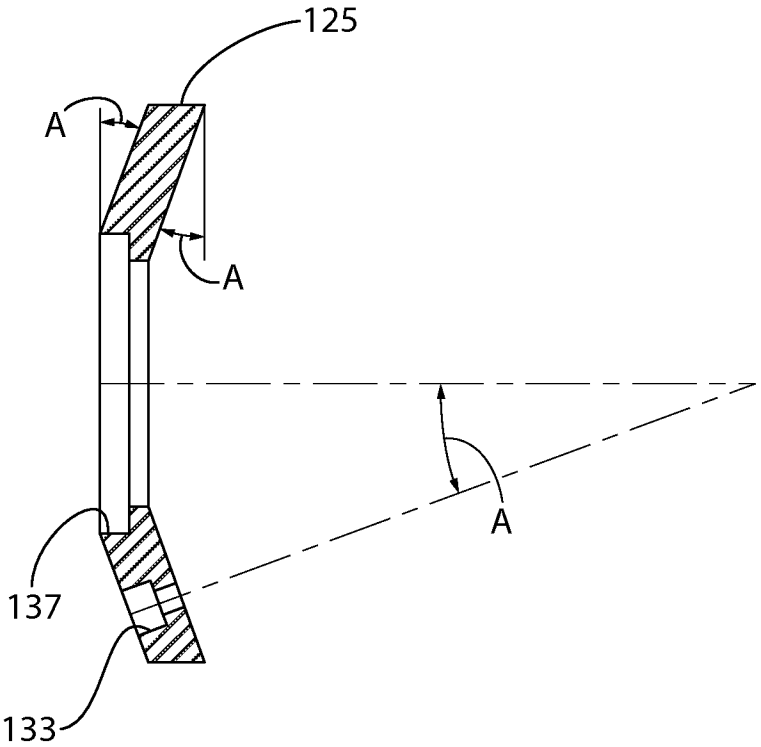
FIG. 9B is a cross-sectional side view of the lid of the vacuum head of FIG. 5.
Figure 9A:
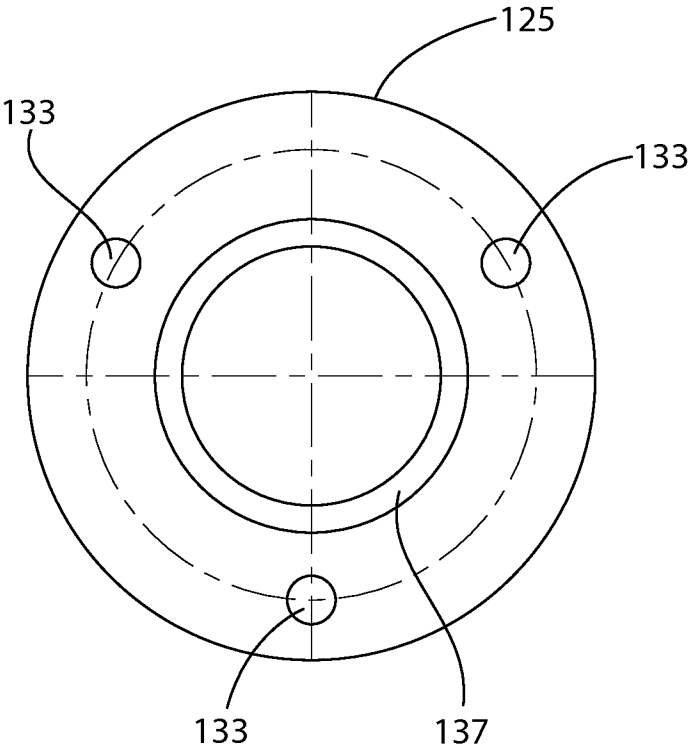
FIG. 9A is an end view of a lid of the vacuum head of FIG. 5.

FIGS. 7A-7C and 8 illustrate various aspects of the body 124 of the vacuum head 123. FIG. 7A specifically illustrates partial cross-sectional views from the center of the body 124 to the exterior along lines "AA" and "DD" shown in FIG. 7C. FIG. 7B specifically illustrates partial cross-sectional views from the center of the body 124 to the exterior along lines "BB" and "CC" shown in FIG. 7C. FIG. 8 illustrates a longitudinal cross-sectional view of the body 124 and the mixing tube 101 taken along a plane intersecting three threaded holes 134. The housing tubes 118 are omitted from FIG. 8 for the sake of clarity and to demonstrate that the threaded holes 134 may be disposed in the body 124 beyond the housing tubes 118 in the longitudinal direction.

With reference to FIGS. 3, 4, 6, 7A, and 8, the body 124 includes one or more radially extending threaded holes 134 that align with locating holes 135 formed in the tube wall 106 of the mixing tube 101. The threaded holes 134 accommodate self locking set screws 148 for connecting the vacuum body 123 to the outer surface 109 of the mixing tube 101. As shown in FIG. 8, the threaded holes 134 are arranged within a single plane and are equally circumferentially spaced within the body 124. The set screws 148 have extended tips, which engage the holes 135 in the mixing tube 101. When at least three set screws 148 are utilized and positioned within respective threaded holes 134, the set screws 148 center the mixing tube 101 in the bore of the body 124 and fix the mixing tube 101 and the vacuum head 123 together along the plane of the threaded holes 134, which extends perpendicular to the coexisting axes of the vacuum head 123 and the mixing tube 101.

In this manner, the vacuum head 123 and the nozzles 112 may be readily disconnected and removed from the mixing tube 101. As opposed to many other designs of vacuums, the disclosed pass-through vacuum head 123 does not come in contact with the transported material, so is not subject to wear. As flowable material passes through the mixing tube 101, the mixing tube 101, on the other hand, will experience a relatively high amount of wear while the vacuum head 123 will not. Accordingly, the less costly mixing tube 101 may be easily replaced when it becomes too worn while the more expensive vacuum head 123 and nozzles 112 are preserved for re-use. Being separate from the mixing tube 101, the vacuum head 123 material may also be optimized for its use such as aluminum for light weight. It is to be appreciated that the set screws 148 may be replaced with any fastener or connector known to be suitable by those having ordinary skill in the art.

As shown in FIGS. 5 and 5A, sealing elements 131, 132 are disposed between the vacuum head 123 and the outer surface 109 of the mixing tube 101. The sealing elements 131, 132 may be any one of a number of configurations such as v-rings. The seals prevent extraneous entrained gas from entering the mixing tube 101 and taking away from the amount 17 entering the inlet tube 12. Apertures 110 in the mixing tube 101 are accordingly also disposed between the two sealing elements 131, 132. The body 124 may include a recess 136 extending around the periphery of the mixing tube 101 for accommodating the sealing element 132. The lid 125 may include a recess 137 extending along the periphery of the mixing tube 101 for accommodating the sealing element 131.

According to a preferred embodiment of the present invention, the vacuum head 123 has multiple locations of housing tubes 118 for installation of nozzle assemblies 111. This arrangement offers several improvements over the prior art where the number and sizes of nozzle are fixed. For instance, by varying the number of nozzles, the amount of head can be varied. Also, one vacuum head can thus be combined with different sizes of gas compressors. To that end, FIG. 5B illustrates an embodiment of the present invention wherein the vacuum head 123 includes one or more mechanisms 150 configured to close off the flow of compressed gas to an individual nozzle assembly 111, thereby changing the amount of input flow through the vacuum head 123 without having to disassemble the lid 125 of the vacuum head 123 from the body 124. The mechanism 150 includes an assembly 151 with a compliant sealing washer top 152; a support button head 153; a body 154 having an external screw thread; a screwdriver slot 155 defined in the body; a sealing washer 157; and a nut 158. When retracted, the head 153 and the sealing washer top 152 fit in a counterbore 156 defined in the lid 125. The support head 153 seals against the inside of the lid 125 when it is retracted using conventional means, such as an O-ring (not shown). When it is desired to cut off the flow of gas to the inlet 115 of the nozzle assembly 111, the threaded body 154 is advanced into the manifold cavity 119 by rotating the body 154 via the slot 155 until the sealing washer top 152 comes into contact with the outlet 115 of the nozzle assembly 111. The nut 158 is then tightened against the outside of the lid 125 to compress the sealing washer 157 and prevent the leaking of gas around the body 154 through the lid 125. When flow through the particular nozzle assembly 111 is desired, the procedure is reversed. Alternatively, unused housing tubes 118 may simply be blocked using standard SAE plugs.

With reference to FIG. 3, the vacuum 100 includes a control valve 122 in fluid communication with the inlet 120 of the vacuum head 123 and thus the inlets 115 of the nozzles 112. The control valve 122 is configured to regulate the flow of compressed gas from the compressed gas source 18 to the nozzles 112 and the mixing tube 101. The control valve 122 includes a handle portion 126 suitable to be handled by the worker 11. A lever 127 is actuated by the worker 11 to open and close the control valve 122 by pivoting with respect to the handle portion 126 to depress a button 128 operatively connected to the valve mechanism (not shown). The control valve 122 is connected to the outlet 120 of the vacuum head 123 by a conduit 129 composed of standard pipe fittings. It is to be noted that the lever 127 is disposed between the handle 126 and the mixing tube 101. In this manner a trigger guard is not necessary to prevent accidental activation of the vacuum if the unit were to be dropped. It is also to be appreciated that the control valve 122 may be of any configuration or type known to be suitable to those having ordinary skill in the art. For instance, the valve 122 may be a ball type with a handle that will stay in an open or closed position on its own or may be of a squeeze, i.e. dead-man, type that must be held open continuously. Alternatively, a foot valve arrangement or a solenoid type valve having a remote activation switch may be employed to enable the operator to have both hands free. Also, the valve 122 may be constructed such that the position of the valve 122 can be adjusted relative to the longitudinal axis 102 by rotation to assist in handling.

Figure 11:
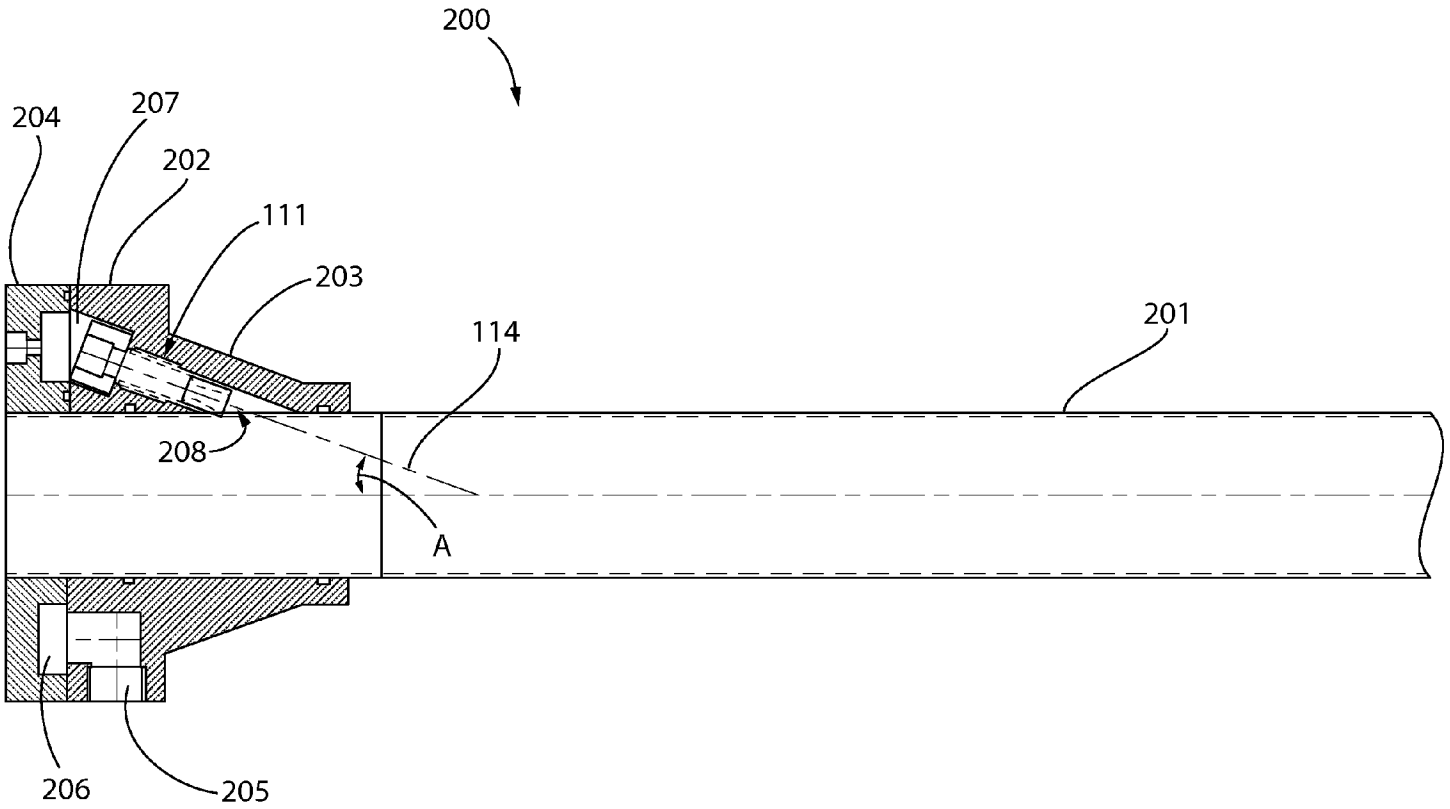
FIG. 11 is a cross-sectional side view of an air powered pass-through vacuum in accordance with an alternate embodiment of the present invention.

With reference to FIG. 11, a pass-through vacuum 200 according to another embodiment of the present invention is depicted. The vacuum 200 includes a mixing tube 201 and a vacuum head 202 removably connected to the mixing tube 201. The mixing tube 201 and vacuum head 202 similar to the corresponding components of the vacuum 100 discussed above with reference to FIGS. 3-10 except that a portion of the body 203 and the lid 204 of the vacuum head 202 have a squared-off cylindrical shape rather than contoured corresponding to the angle A of the nozzle axis 114. The body 203 includes an inlet 205 defined therein for communicating the vacuum head 202 with the compressed gas source 18. The inlet 205 is in fluid communication with a manifold cavity 206 formed as a channel within the lid 204 with the base of the manifold cavity 206 being formed by a surface of the body 203. The body 203 also includes a plurality of housing tubes 207 extending along the nozzle axis 114, which contain the supersonic nozzles 112 and align the outlets 116 of the nozzles 112 with the apertures 208 in the mixing tube 201.

Figure 12:
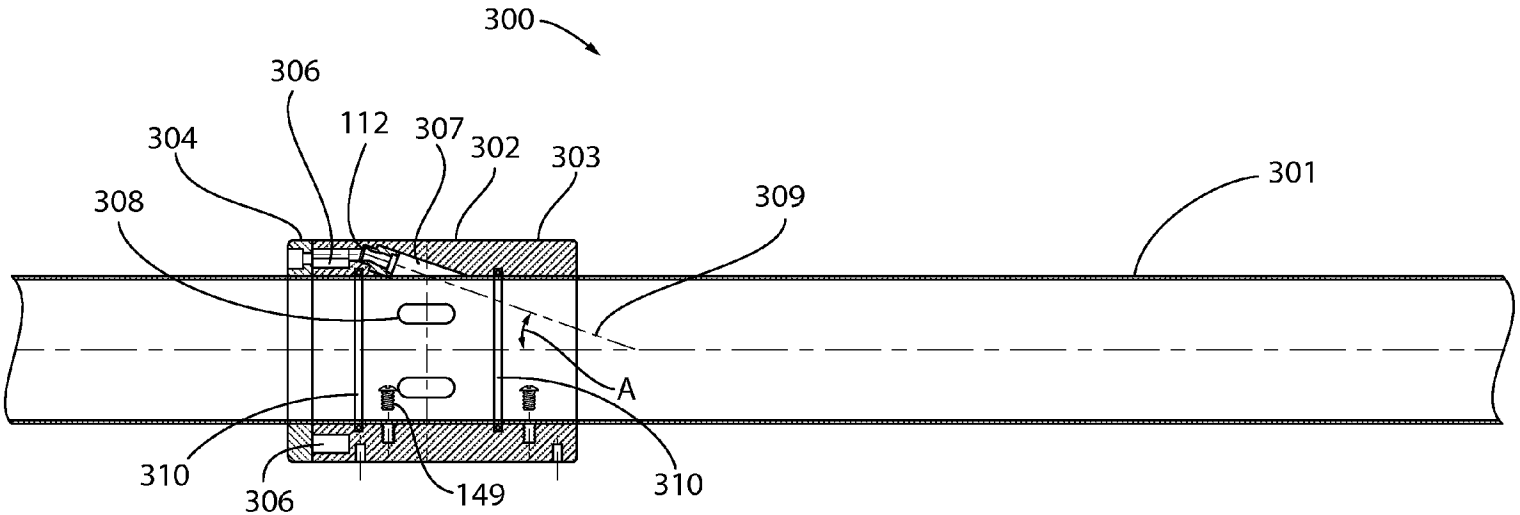
FIG. 12 is a cross-sectional side view of an air powered pass-through vacuum in accordance with an alternate embodiment of the present invention.
Figure 12A:
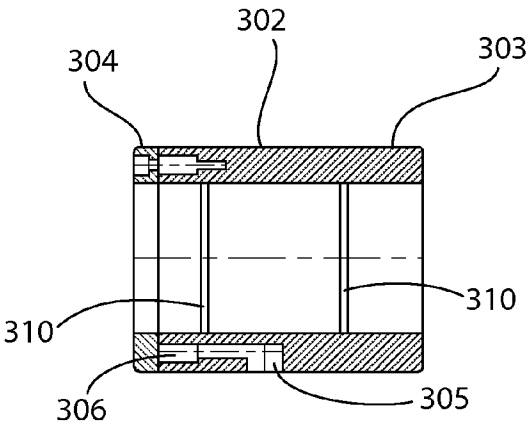
FIG. 12A is an alternate cross-sectional side view of the vacuum head of the vacuum of FIG. 12.
Figure 13:
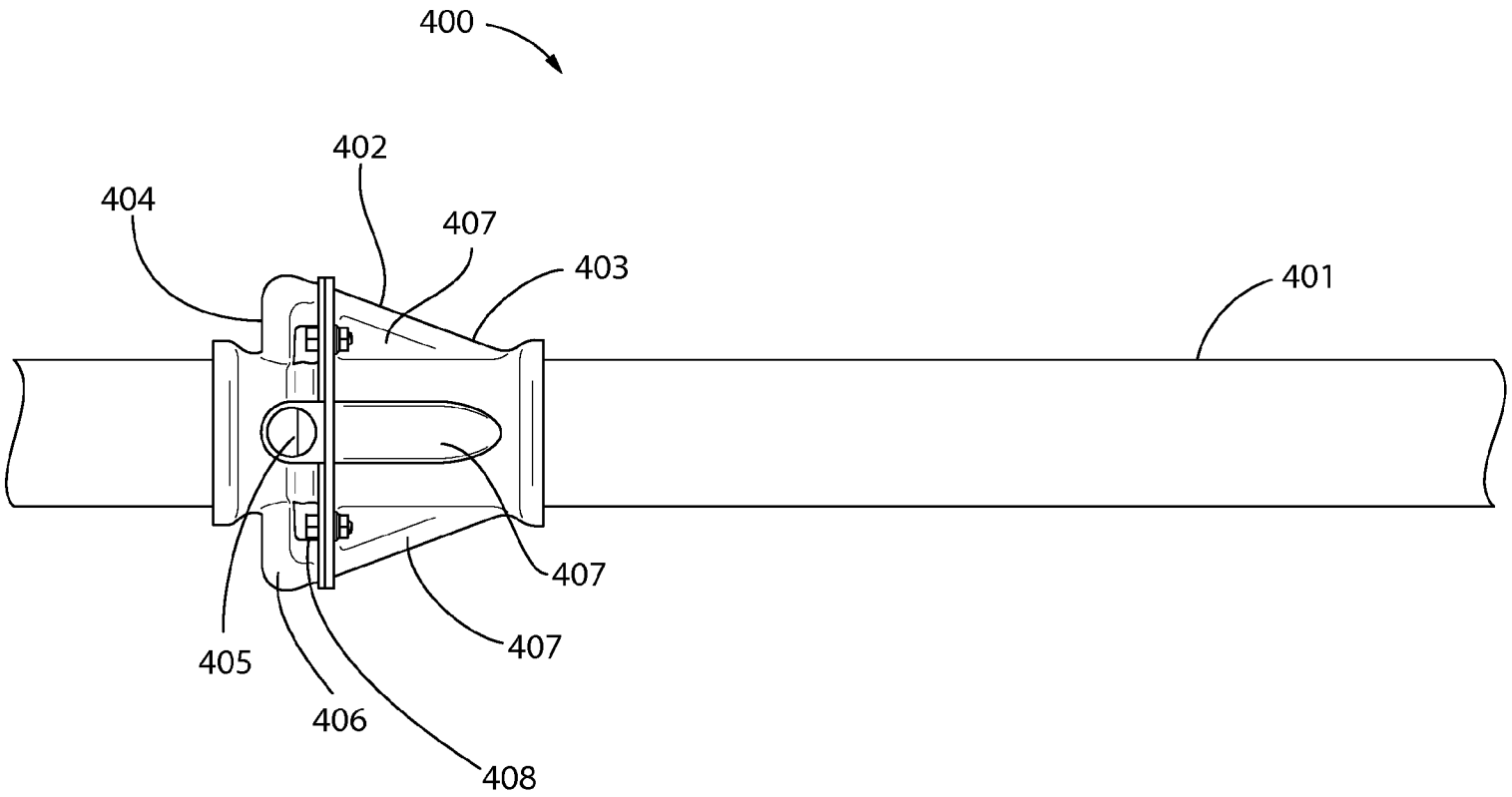
FIG. 13 is a side view of an air powered pass-through vacuum in accordance with an embodiment of the present invention.
Figure 14:
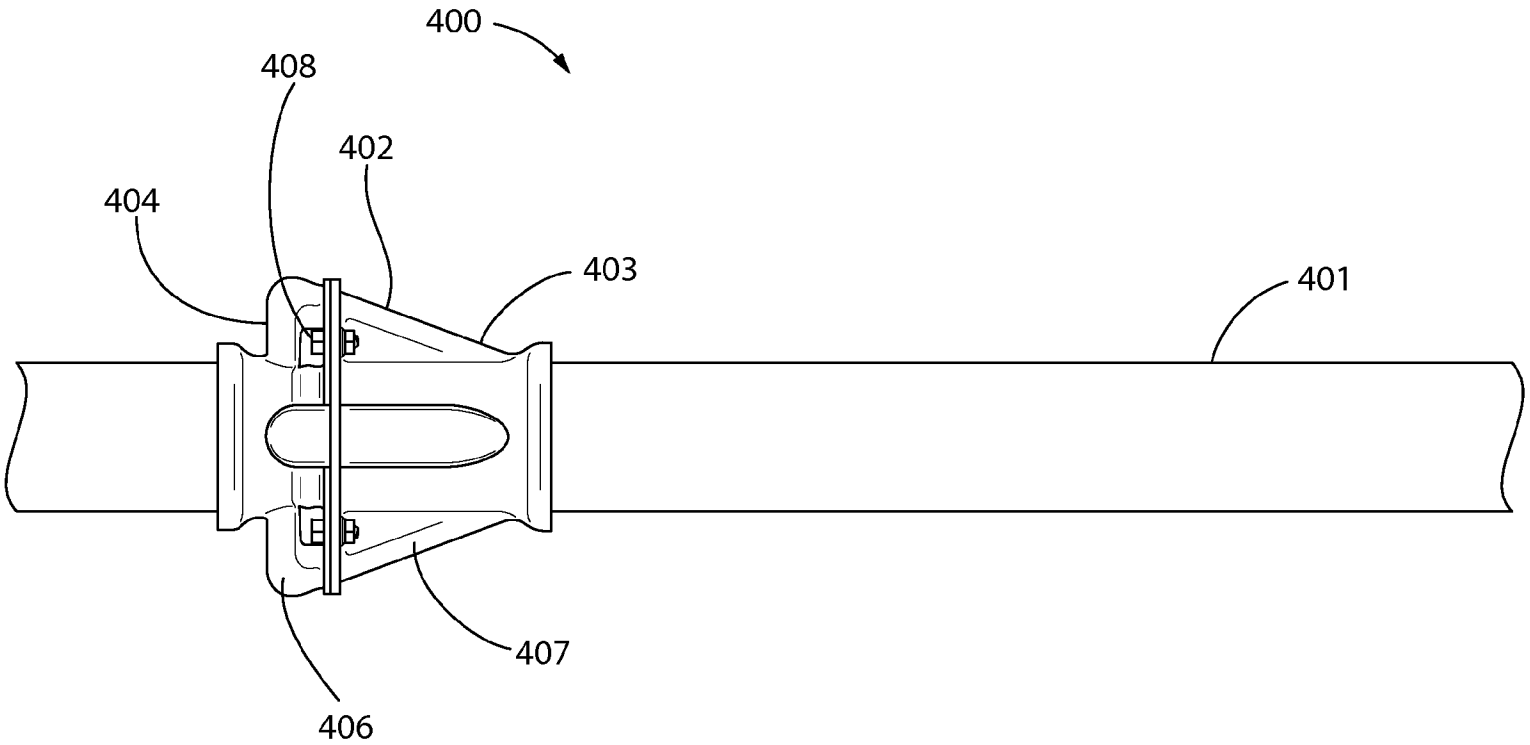
FIG. 14 is an alternate side view of the vacuum of FIG. 13.
Figure 15:
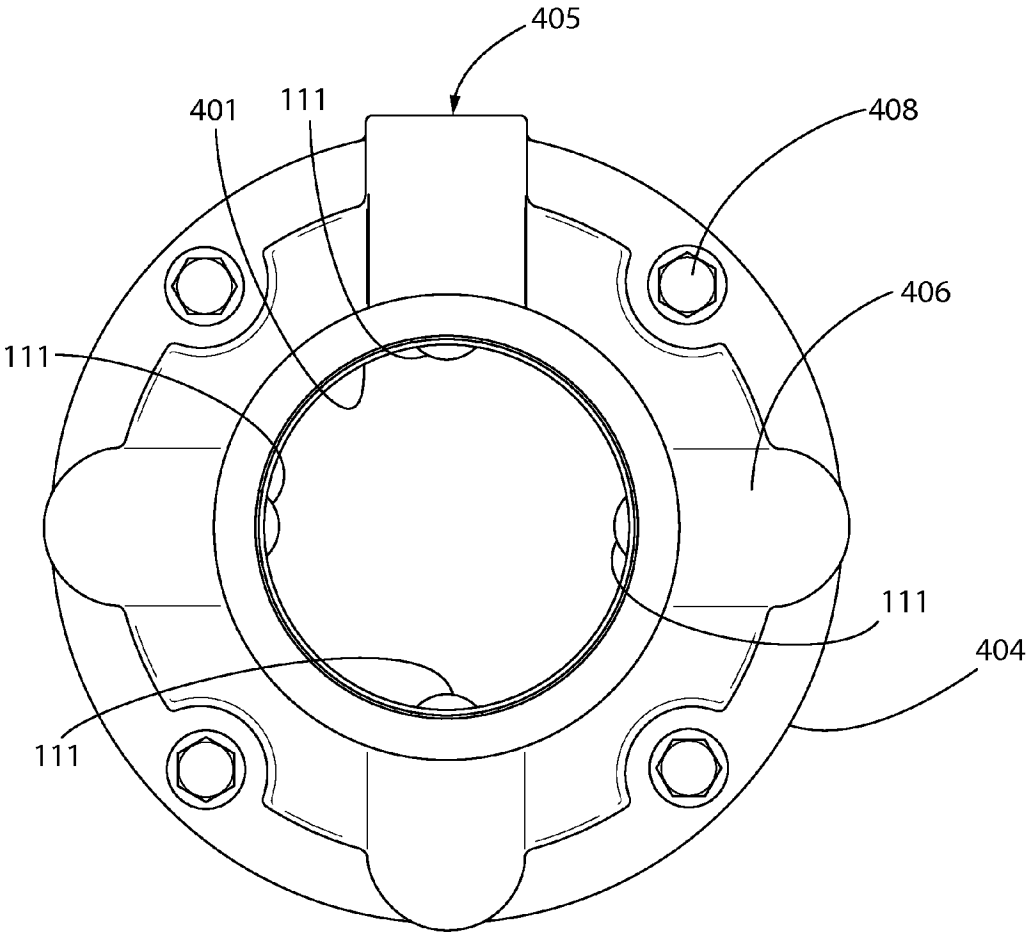
FIG. 15 is an entrance end view of the vacuum of FIG. 13.
Figure 16:
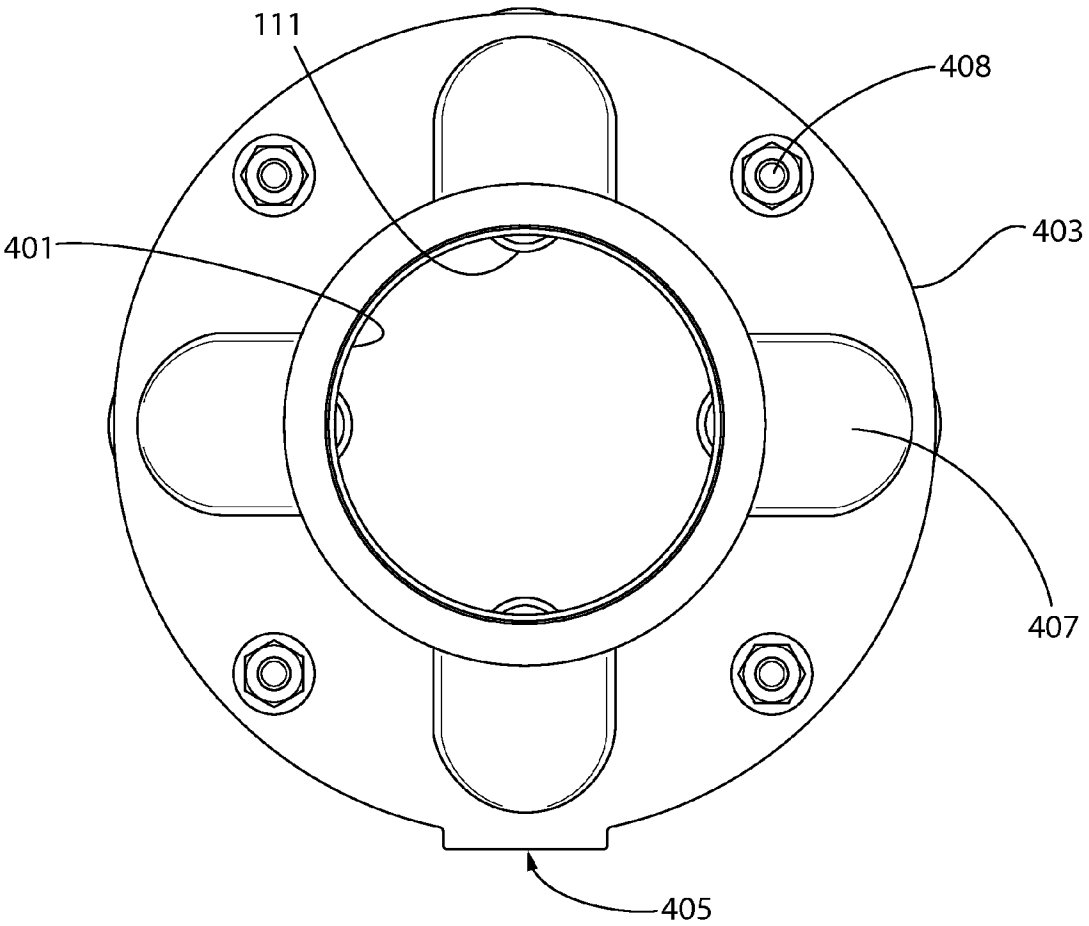
FIG. 16 is an exit end view of the vacuum of FIG. 13.
Figure 17:
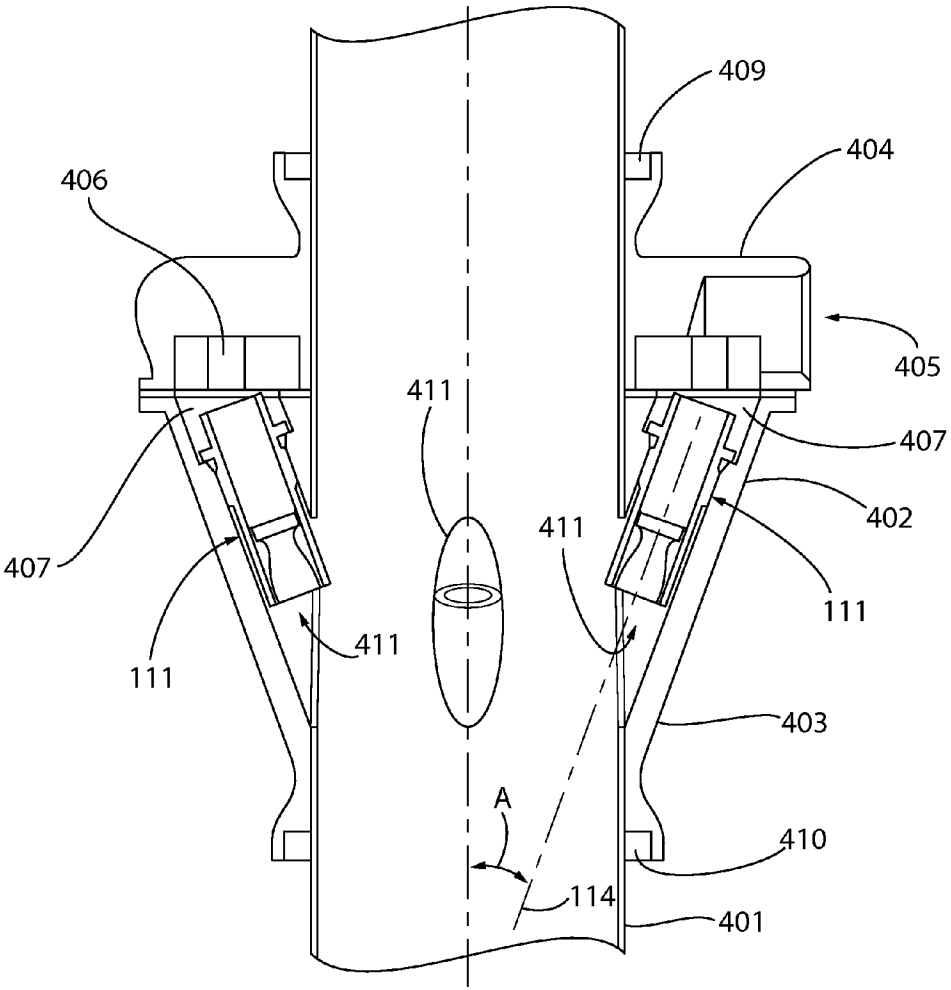
FIG. 17 is a cross-sectional side view of the vacuum of FIG. 13.

With reference to FIGS. 12 and 12A, a pass-through vacuum 300 according to another embodiment of the present invention is depicted. The vacuum 300 includes a mixing tube 301 and a machined vacuum head 302 removably connected to the mixing tube 301. The mixing tube 301 and the vacuum head 302 are similar to the corresponding components of the vacuum 100 discussed above with reference to FIGS. 3-10 except that the body 303 and the lid 304 of the vacuum head 302 have a cylindrical shape. The body 303 includes an inlet 305 defined therein for communicating the vacuum head 302 with the compressed gas source 18. The inlet 305 is in fluid communication with a manifold cavity 306 formed as a channel within the body 303 with the top of the manifold cavity 306 being formed by a surface of the lid 304. The body 303 also includes a plurality of housing tubes 307 extending along an axis 309 that forms the acute angle A with the central longitudinal axis of the mixing tube 301 so as to coincide with the nozzle axis 114. The housing tubes 307 are configured to contain supersonic nozzles 112 and align the outlets 116 of the nozzles 112 with the apertures 308 in the mixing tube 301. Channels 310 may also be formed in the vacuum head 302 for receiving sealing elements, such as O-rings, that seal the attachment between the mixing tube 301 and the vacuum head 302. The vacuum head 302 is connected to the inside surface of the mixing tube 301 by button head screws 149 with extend through the mixing tube to engage threaded holes on the inside surface of the vacuum head 302.

With reference to FIGS. 13-17, a pass-through vacuum 400 according to another embodiment of the present invention is depicted. The vacuum 400 includes a mixing tube 401 corresponding to the mixing tube 101 discussed above. The vacuum 400 also includes an integrally molded or cast vacuum head 402 that is removably connected to the mixing tube 401 by fasteners or other connectors, such as described above with reference to FIGS. 3-8. The vacuum head 402 includes a body 403 and a lid 404 connected together in an abutting relationship by fasteners 408. The lid 404 includes an inlet 405 defined therein for communicating the vacuum head 402 with the compressed gas source 18. The inlet 405 is in fluid communication with a manifold cavity 406 formed as a channel within the lid 404 with the base of the manifold cavity 406 being formed by a surface of the body 403. The body 403 includes a plurality of housing tubes 407 extending along the nozzle axis 114. The housing tubes 407 are configured to contain supersonic nozzles 112 and align the outlets 116 of the nozzles 112 with the apertures 411 in the mixing tube 401. Recesses 409, 410 may also be formed in the lid 404 and the body 403, respectively, for receiving sealing elements that seal the attachment between the mixing tube 401 and the vacuum head 402. As shown, the supersonic nozzle 112 is a separate component from the housing tube 407 that alternately may be made of a suitable plastic material. In large quantities the vacuum head shown in FIGS. 13-17 should be lighter in weight and have significant production cost advantages over the machined vacuum heads described in the previous embodiments.

It is to be appreciated that the vacuum 400, according to this embodiment, may be cast or molded from any material known to be suitable to those having ordinary skill in the art. Such materials may include metal materials and/or plastic or polymeric materials. It is also to be appreciated that vacuum heads 123, 202, 302, 402 discussed above may be readily removed and are interchangeable from the respective mixing tubes 101, 201, 301, 401 such that the heads 123, 202, 302, 402 may be used after the mixing tubes 101, 201, 301, 401 require replacement due to wear or damage.

Figure 18:
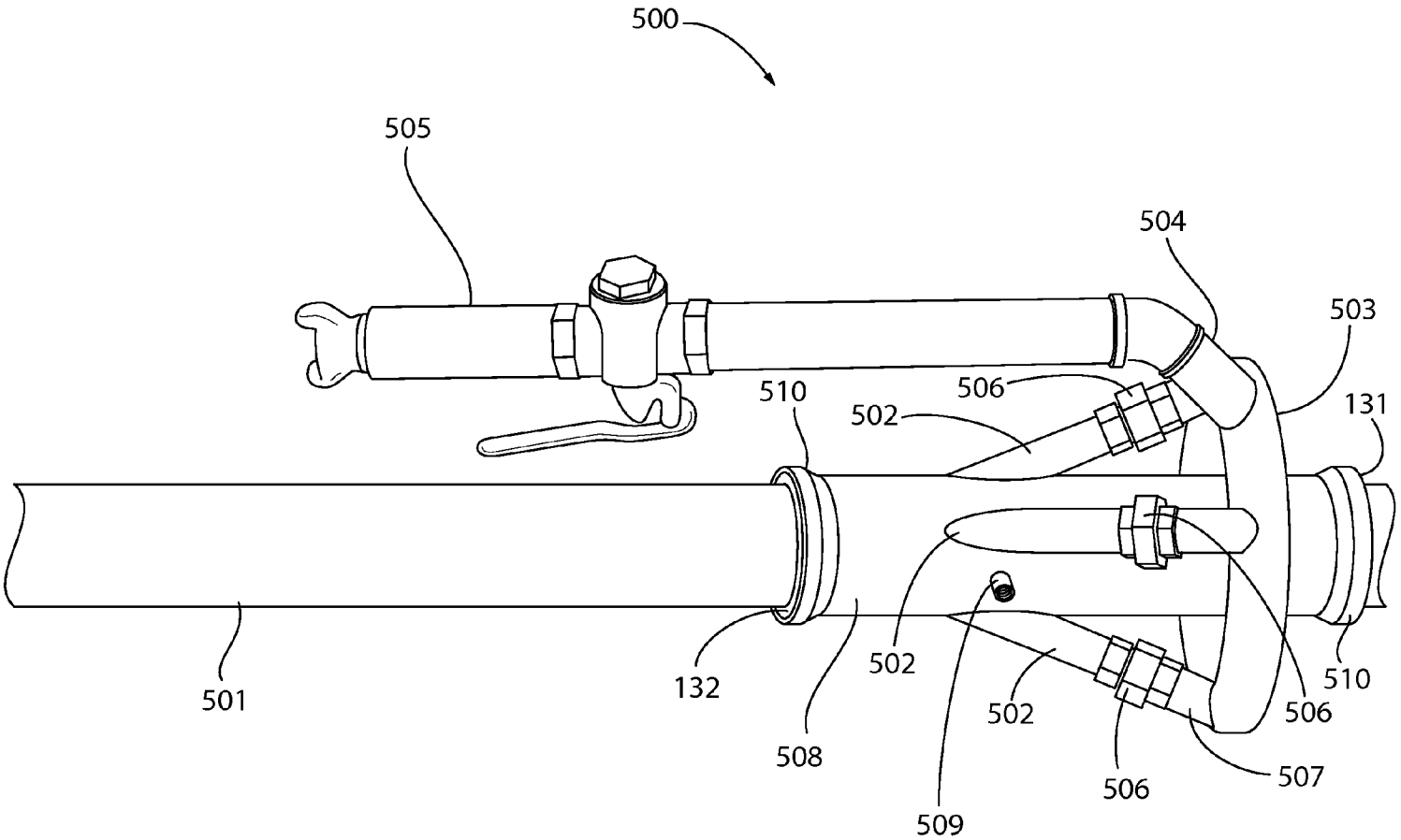
FIG. 18 is a perspective view of an air powered pass-through vacuum in accordance with another embodiment of the present invention.

With reference to FIG. 18, a pass-through vacuum 500 in accordance with another embodiment of the present invention is depicted. The vacuum 500 includes a mixing tube 501 corresponding to the mixing tube 101 discussed above. The nozzles 112 are disposed within housing tubes 502, which are cut and extend along the tube axis at the acute angle A. The housing tubes 502 are attached by suitable methods, such as welding, to an external tube 508 disposed about the periphery of the mixing tube 501. The external tube 508 is removably connected to the mixing tube 501 by fasteners, such as set screws 148, which threadably engage a threaded coupling 509 disposed on the external tube 508, as shown in FIG. 20A. The external tube 508 aligns the housing tubes 502 along the outer surface of the mixing tube 501 to mate the housing tubes 502 with elliptical apertures in the mixing tube 501. The external tube 508 may also include enlarged lips 510 formed at the longitudinal ends thereof for containing vacuum seals 131, 132 to seal the connection between the external tube 508 and the mixing tube 501 against the entry of outside gas. The housing tube 502 may be constructed of heavy wall pipe that is counter bored to create a shoulder against which the nozzle 112 rests. To achieve a superior and higher level of suction, the exit end 116 of the nozzle 112 should be disposed as closely as possible to the inside of the mixing tube 501.

As shown in FIG. 18, a plurality of nozzles 112 disposed within housing tubes 502 are equally spaced about the periphery of the mixing tube 501. The nozzles 112 and housing tubes 502 are connected by a manifold 503 having an inlet 504 that is configured to be connected to the compressed gas source 18 via a control valve 505. The manifold 503 is a hollow ring or toroid surrounding and encircling the periphery of the mixing tube 501. The manifold 503 also includes a plurality of outlets 507 that are connected to inlets of the housing tubes 502 opposite to the mixing tube 501 by rotary unions 506 or other suitable mechanisms that allow assembly and disassembly such that the outlets 507 and the manifold 503 are in fluid communication with the inlets of the housing tubes 502 and the manifold 503 is supported in the position encircling the mixing tube 501.

Figure 19:
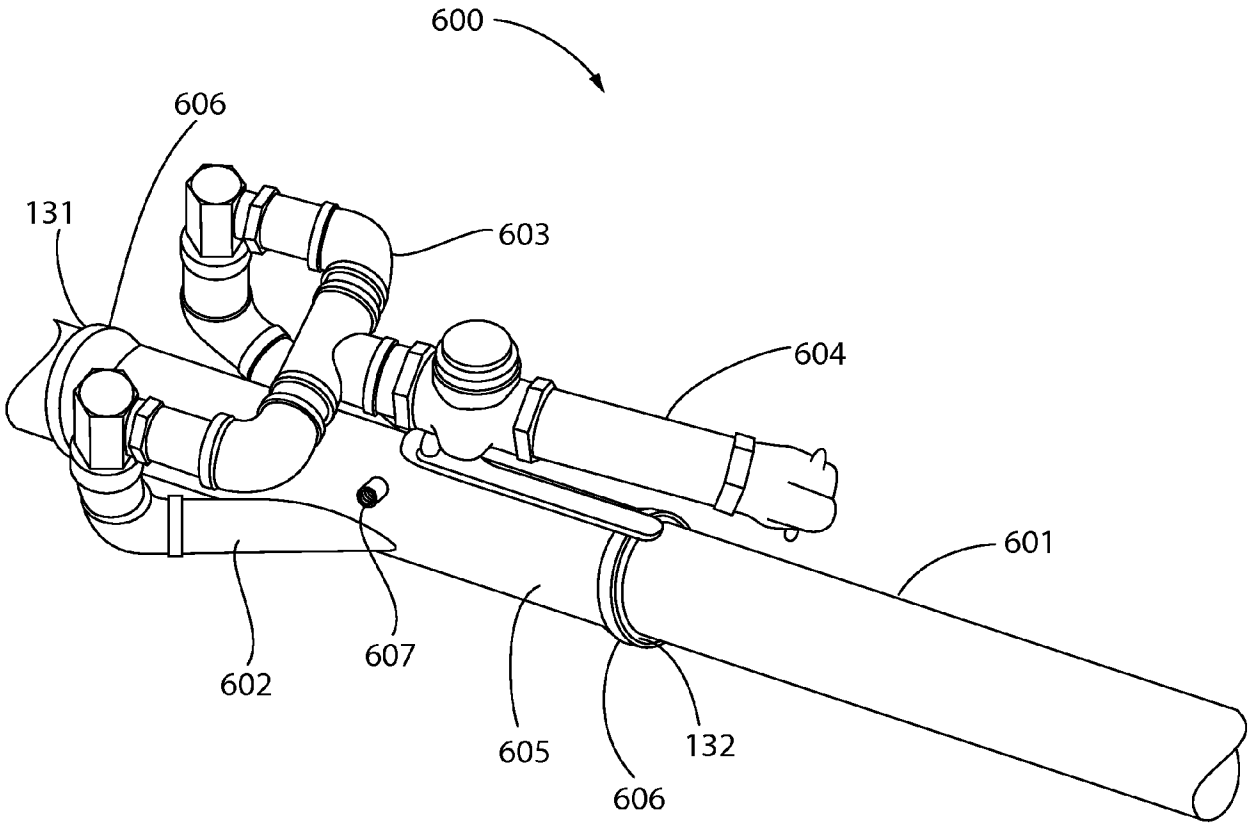
FIG. 19 is a perspective view of an air powered pass-through vacuum in accordance with another embodiment of the present invention.

With reference to FIG. 19, a pass-through vacuum 600 in accordance with another embodiment of the present invention is depicted. The vacuum 600 includes a mixing tube 601 corresponding to the mixing tube 101 discussed above. As shown, there are two nozzles that are disposed within equally spaced housing tubes 602, which are attached by a suitable method, such as welding, to an external tube 605 disposed about the periphery of the mixing tube 601. The external tube 605 is removably connected to the mixing tube 601 by fasteners, such as set screws 148, which threadably engage a threaded coupling 607 disposed on the external tube 605, as shown in FIG. 20A. The external tube 605 aligns the housing tubes 602 along the outer surface of the mixing tube 601 to mate the housing tubes 602 with elliptical apertures in the mixing tube 601. The external tube 605 may also include enlarged lips 606 formed at the longitudinal ends thereof for containing vacuum seals 131, 132 to seal the connection between the external tube 605 and the mixing tube 601 against the entry of outside gas. The housing tube 602 may be constructed of heavy wall pipe that is counter bored to create a shoulder against which the nozzle 112 rests. To achieve a superior and higher level of suction, the exit end 116 of the nozzle 112 should be disposed as closely as possible to the inside of the mixing tube 501. The nozzles are connected by a U-shaped manifold 603 constructed, for example, using standard pipe fittings that are configured to be connected to the compressed gas source 18 via a control valve 604.

Figure 20:
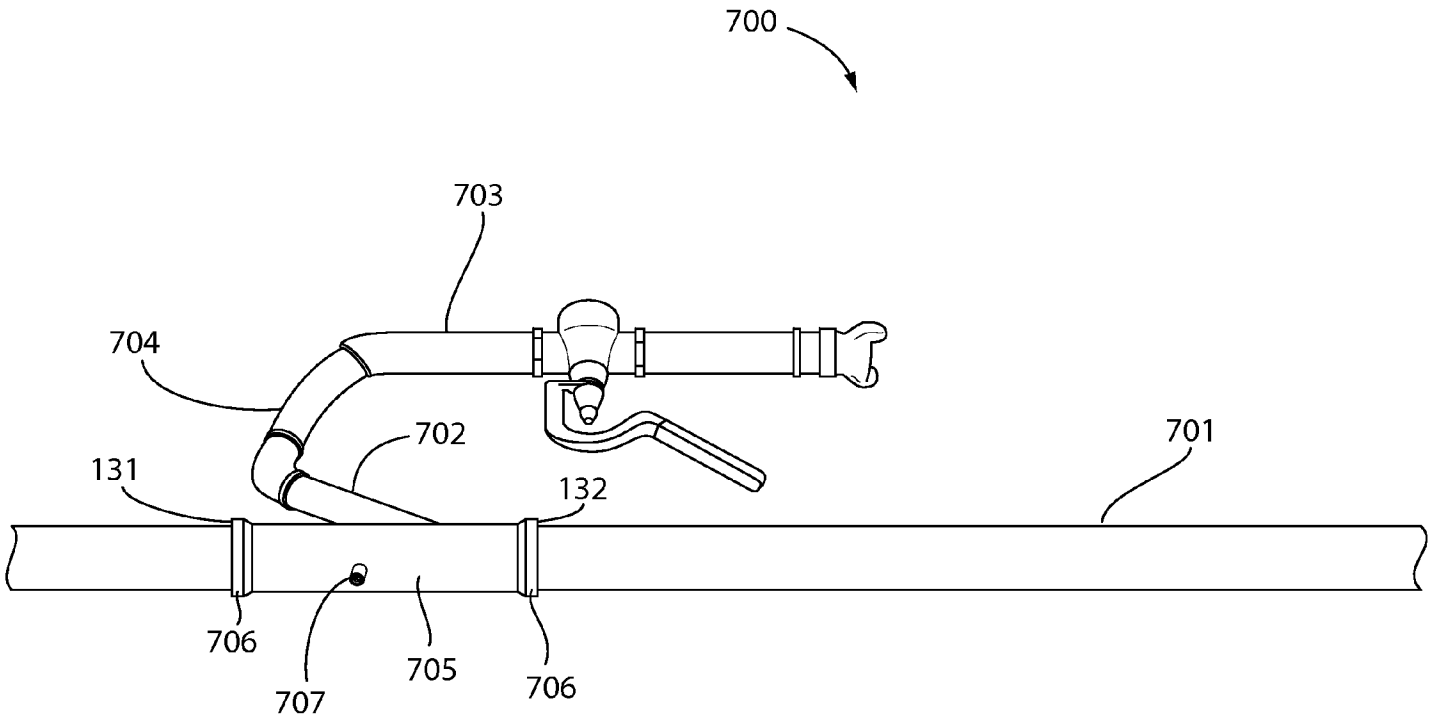
FIG. 20 is a perspective view of an air powered pass-through vacuum in accordance with another embodiment of the present invention.
Figure 20A:
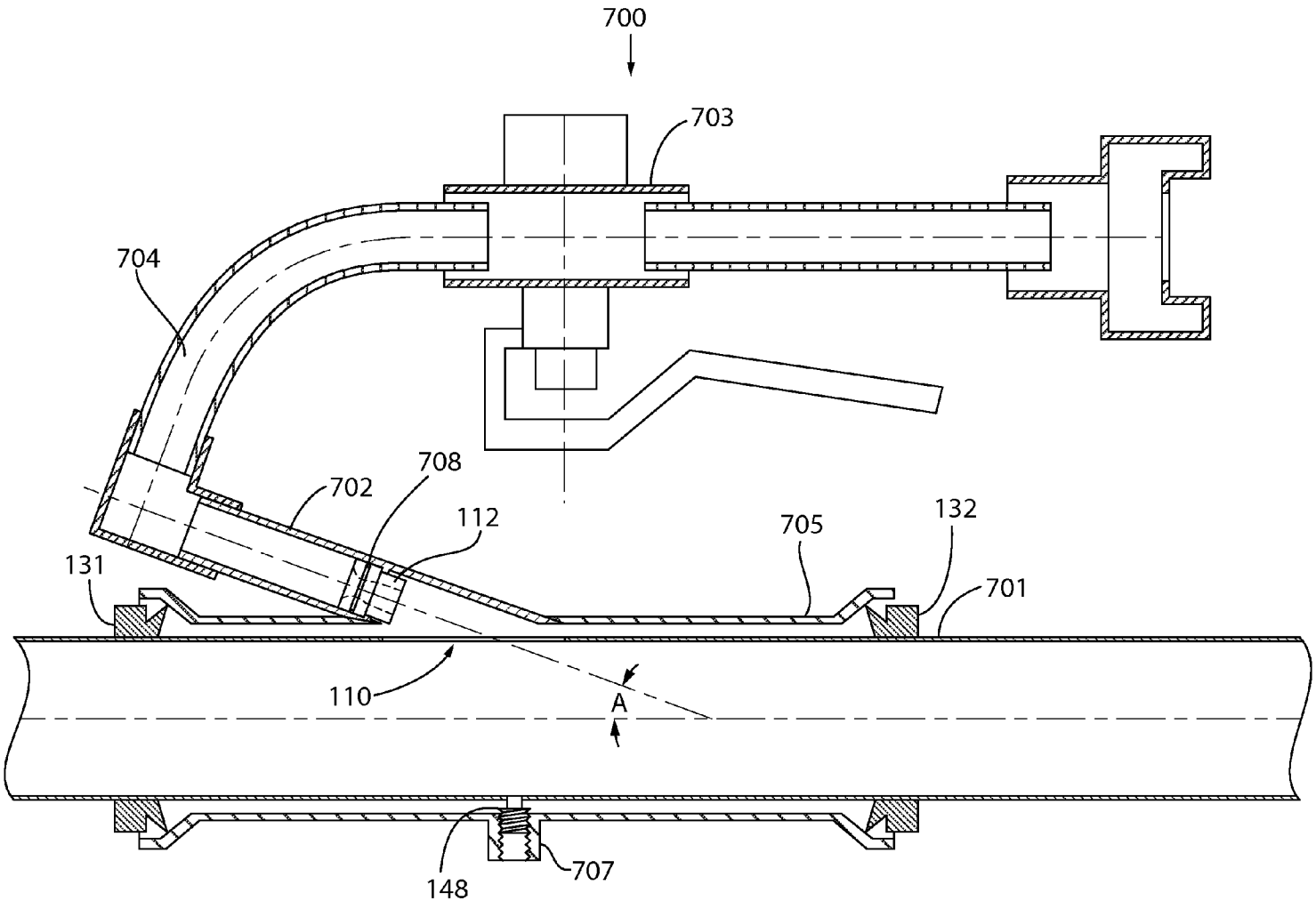
FIG. 20A is a cross-sectional view of the embodiment shown in FIG. 20.

With reference to FIGS. 20 and 20A, a pass-through vacuum 700 in accordance with another embodiment of the present invention is depicted. The vacuum 700 includes a mixing tube 701 corresponding to the mixing tube 101 discussed above. As shown in FIG. 20A, there is a single nozzle 112 disposed within a housing tube 702 extending along the acute angle A with respect to the longitudinal axis and attached by a suitable method, such as welding, to an external tube 705 disposed about the periphery of the mixing tube 701. The external tube 705 is removably connected to the mixing tube 701 by fasteners, such as set screws 148, which threadably engage a threaded coupling 707 disposed on the external tube 705. The external tube 705 aligns the housing tube 702 along the outer surface of the mixing tube 701 to mate the housing tube 702 with elliptical apertures in the mixing tube 701. The external tube 705 may also include enlarged lips 706 formed at the longitudinal ends thereof for containing vacuum seals 131, 132 to seal the connection between the external tube 705 and the mixing tube 701 against the escape of entrained gas.

An O-ring 708 seals the space between the outside of the nozzle 112 and the inside of the housing tube 702. The housing tube is 702 constructed of heavy wall pipe that is counter bored to create a shoulder against which the nozzle 112 rests. To achieve a superior and higher level of suction, the exit end of the supersonic nozzle 112 should be disposed as closely as possible to the inside of the mixing tube 701. The housing tube 702 is configured to place the nozzle 112 in fluid communication with the compressed gas source via a control valve 703 that is connected to the housing tube 702 by a connector 704, in this case, a bent section of pipe and a 90 degree elbow. The housing tube 702 and mixing tube 701 are selected to be of compatible materials for joining and may be selected to meet the special needs of the material being vacuumed. For example, harder carbon steel may be used if the conveyed material is abrasive; while aluminum, brass, or stainless steel may be used if a non-sparking nature is required.

Figure 21B:
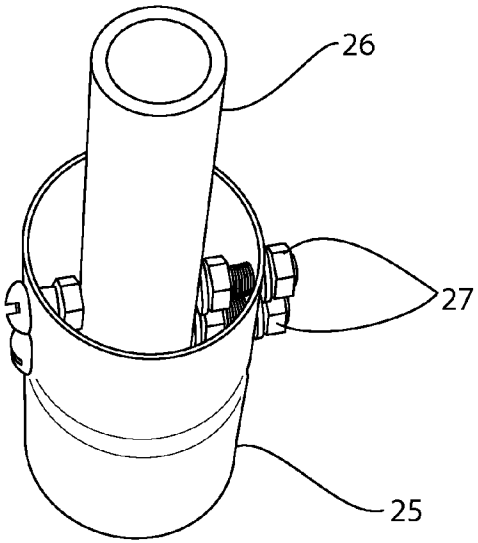
FIGS. 21A and 21B are perspective views of a water suction adapter in accordance with an embodiment of the present invention.
Figure 21A:
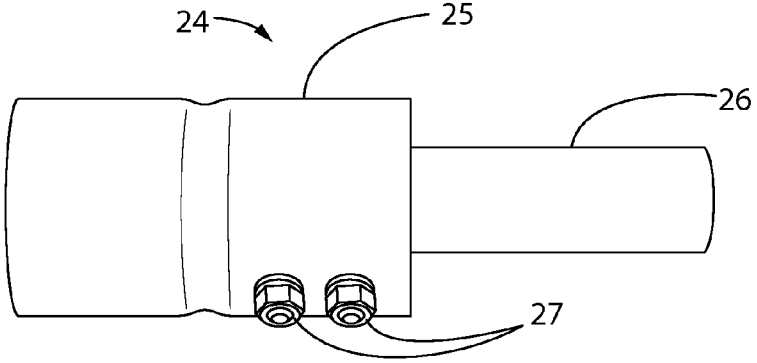
Figure 21C:
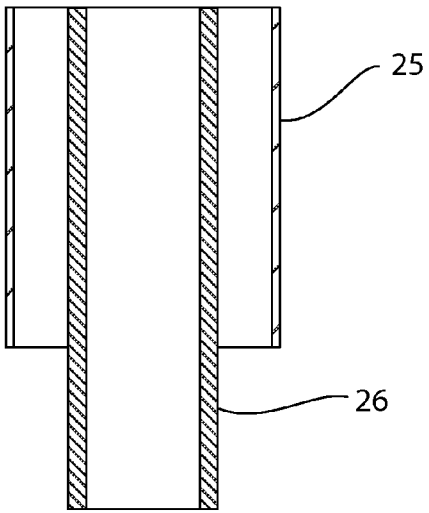
FIG. 21C is a cross-sectional side view of the water suction adapter of FIGS. 21A and 21B.

With reference to FIGS. 21A-21C, a water suction adapter 24 according to an embodiment of the present invention is depicted. The adapter 24 may be disposed on the entrance end 13 of the inlet vacuum tube 12 shown in FIG. 1. The adapter 24 includes an outer piece 25 that slips over the inlet vacuum tube 12 with a tight fit and a longer inner piece 26 partially disposed within the outer piece 25. Fasteners 27 may be provided to connect the inner piece 26 to the outer piece 25. The inner piece 26 is in fluid communication with the inlet vacuum tube 12 and may be partially submerged in water or other liquid for the purpose of removing the water or liquid from curb or valve service boxes. The outer piece 25 is also in fluid communication with the inlet vacuum tube 12. In this manner, the entrained gas flow 17 may pass into the inlet vacuum tube 12 by way of the annular space formed between pieces 25, 26, while the inner piece 26 is partially submerged to provide suction within the inner piece of the adapter 24 so that liquid may be entrained in the gas flow 17.

More specifically, the gas entrained into the inlet vacuum tube 12 causes a reduction of pressure at the end of the inner piece 26. This pressure differential in turn causes water to flow into the inlet vacuum tube 12 through the inner piece 26. The entrained gas flow entering the inlet vacuum tube 12 then entrains the water and carries it up and through the rest of the vacuum system 10. In this manner the water may be lifted to a higher distance than just the deadhead suction of the vacuum system 10 would allow.

Figure 22:
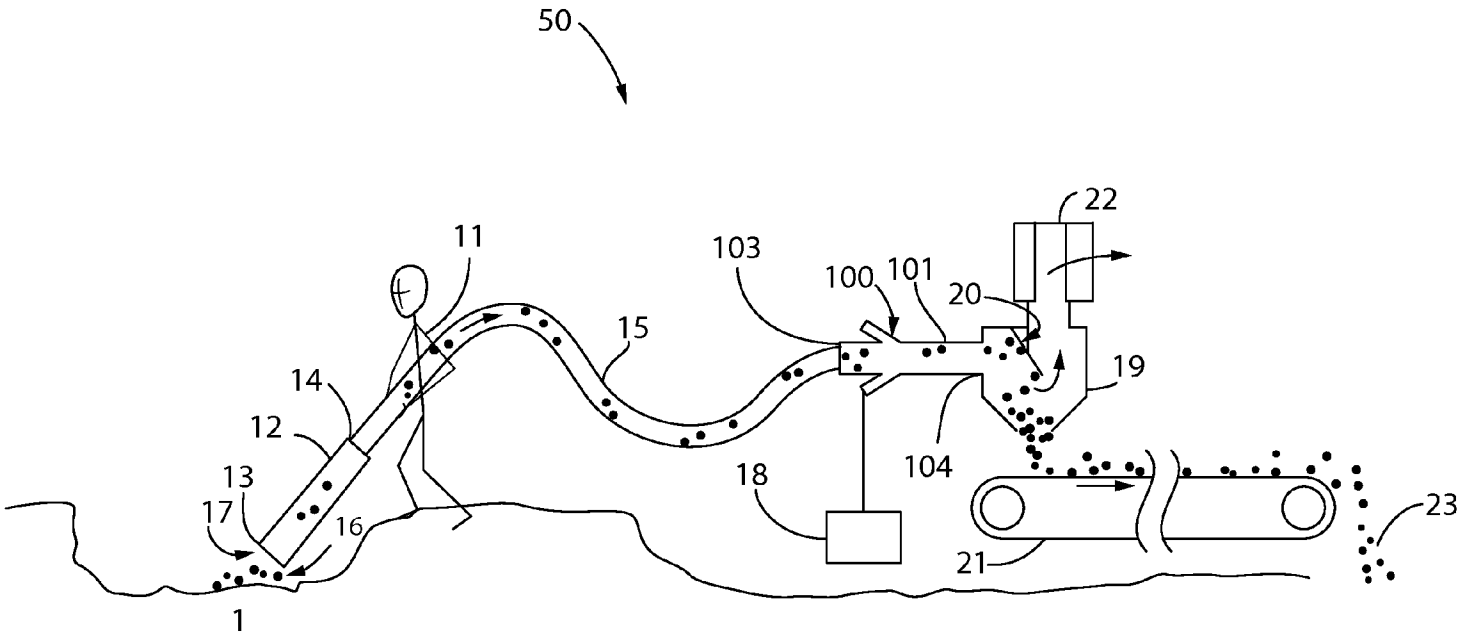
FIG. 22 is a schematic view of a pass-through vacuum system in accordance with an embodiment of the present invention.

With reference to FIG. 22, a pass-through vacuum system 50 in accordance with an alternate embodiment of the present invention is depicted. The system includes an inlet vacuum tube 12 that is held by a worker 11. The inlet vacuum tube has an entrance end 13 and an exit end 14. The entrance end 13 is configured to collect a flowable material 16, such as spoil, via an entrained gas flow 17 entering the entrance end 13. A flexible conduit 15 is connected to the exit end 14 of the inlet vacuum tube 12 such that the flexible conduit 15 is in fluid communication with the inlet vacuum tube 12. The end of flexible conduit 15 opposite to the inlet vacuum tube 12 is connected to an entrance end 103 of a pass-through vacuum 100 such that a mixing tube 101 of the vacuum 100 is in fluid communication with the flexible conduit 15 and the inlet vacuum tube 12. The inlet vacuum tube 12 and the flexible conduit 15 may be made from any suitable material known to those having ordinary skill in the art, include plastic materials. Additionally, the tube 12 and conduit 15 may be made of clear materials so that potential clogs may be seen.

A collector 19 is in fluid communication with an exit end 104 of the mixing tube 101. The collector 19 is configured to receive the flowable material 16 entrained in the gas flow 17. As shown in FIG. 22, the collector 19 is a hopper. The flowable material 16 entrained within the gas stream 17 exits the mixing tube 101 into the collector 19. An impact plate 20 deflects the flowable material 16 downward onto a conveyor 21. The gas turns upward to exit through a low-loss filter 22 as indicated by the arrow shown in FIG. 22. The conveyor 21 transports the flowable material 16 to a disposal location 23, such as a spoils pile. The collector 19 could also be elevated to discharge directly into a truck. Any flowable material 16 exiting the vacuum 100 is safely contained in the hopper 19 as the impact plate 20 absorbs the kinetic energy imparted to the material 16 by the gas stream 17. It is also to be appreciated that the collector 19 may be of any type, for instance a burlap bag, other soft-sided solid waste container, drum, or dump hopper, which is able to collect the flowable material 16 exiting the mixing tube 101 while allowing gas to pass-through or out thereof.

The embodiment of FIG. 22 may be further altered such that the pass-through vacuum 100 is mounted directly to the collector 19. Additionally, an adapter may be provided on the entrance end 103 of the pass-through vacuum 100 such that multiple inlet vacuum tubes 12 may be connected in fluid communication via flexible conduits 15 to a common pass-through vacuum 100 to allow for more than one operator to utilize the pass-through vacuum 100. According to such an embodiment, the sum of the individual areas of the inlet vacuum tubes 12 should be approximately the same as the inside area of the mixing tube 101 so as to evenly distribute suction through all of the inlet vacuum tubes 12.

Figure 23:
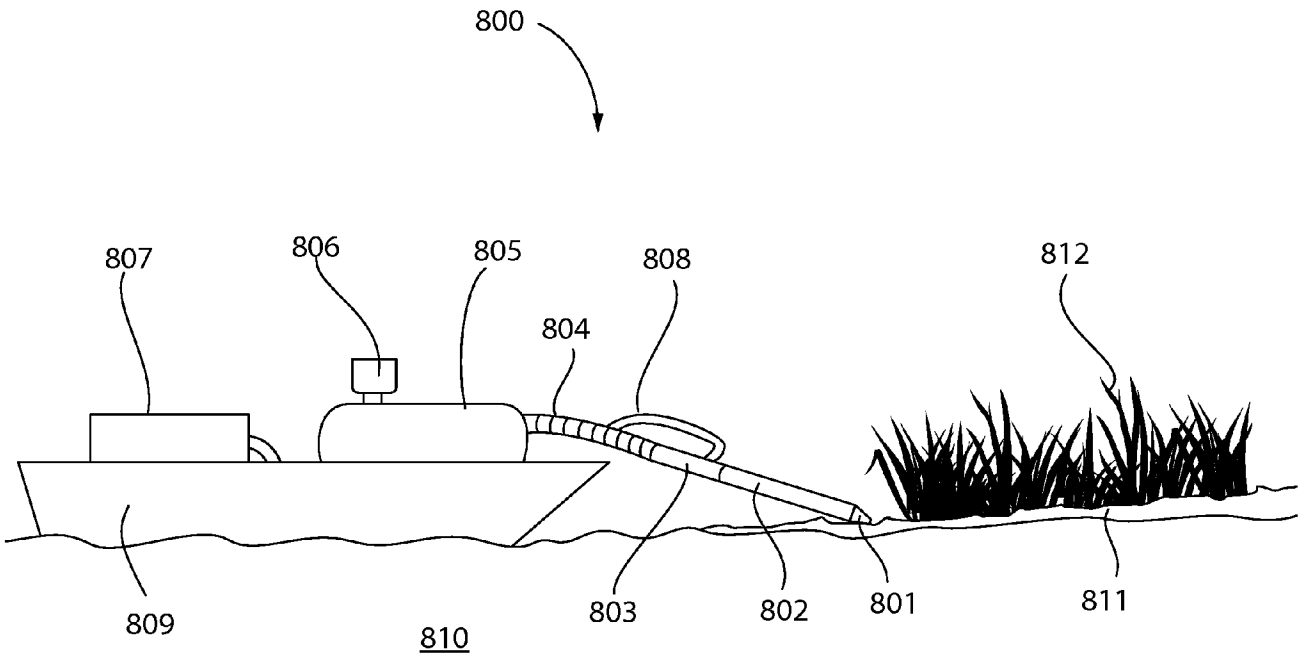
FIG. 23 is a schematic view of another pass-through vacuum system in accordance with an embodiment of the present invention.

With reference to FIG. 23, a pass-through vacuum system 800 in accordance with another embodiment of the present invention is depicted. As shown, the system 800 is disposed in a boat 809 or barge capable of accessing marshy areas of plants 812 in a body of water 810 polluted by an oil slick 811 resulting from an oil spill. The system 800 includes an inlet adapter 801 configured to entrain the oil and water mixture in an gas flow to collect the oil and water mixture and decontaminate the marshy areas and the body of water 810. The inlet adapter 801 may be of similar configuration to the adapter 24 discussed above with reference to FIGS. 21A-21C. The adapter 801 is disposed on an end of an inlet vacuum tube 802, which is in turn connected to a pass-through vacuum 803 according to any one of the several embodiments discussed above. The vacuum 803 is connected to a gas compressor 807 placed in the boat 809 by a gas supply hose 808 connected to the housing tube or vacuum head of the vacuum 803. The vacuum 803 is also connected to an outlet hose 804 that places the vacuum 803 in fluid communication with a storage tank 805 placed in the boat 809. The gas passes out of the tank 805 by way of an outlet gas filter 806.

During operation of the system 800, crude oil may be recovered from the surface or shallow subsurface of the body of water 810 in marshy areas amongst plants by holding the inlet adapter 801 and the inlet vacuum tube 802 in a generally horizontal direction and moving them along the surface or subsurface of the water. The compressed gas from the compressor 807 is provided to the vacuum 803, which forms a supersonic jet to create an entrained gas flow at the adapter 801. The suction created by the entrained gas flow suctions the oil and water mixture of the oil slick 811 and discharges the mixture into the tank 805 via the inlet vacuum tube 802, vacuum 803, and outlet hose 804 without significantly damaging the surrounding plants 812. The entrained gas is discharged through the filter 806.

The pass-through vacuum system 800 should have several other features important to the vacuuming of crude oil. First, the vacuum 803 and all metal parts that come in contact with the suctioned crude oil should be made of a metal that is non-sparking, such as brass. Second, the hoses 804 should be made of material that is resistant to crude oil such as polyvinylchloride or polyurethane. The hose 804 should include a conducting wire to dissipate any static charge. Finally, the inlet adapter 801 may be employed that changes the round configuration of the inlet tube 802 to an elliptical shape of the same cross-sectional area. The major axis of the elliptical inlet would be oriented parallel to the water surface to increase the contact area with the oil slick 811.

Figure 24:
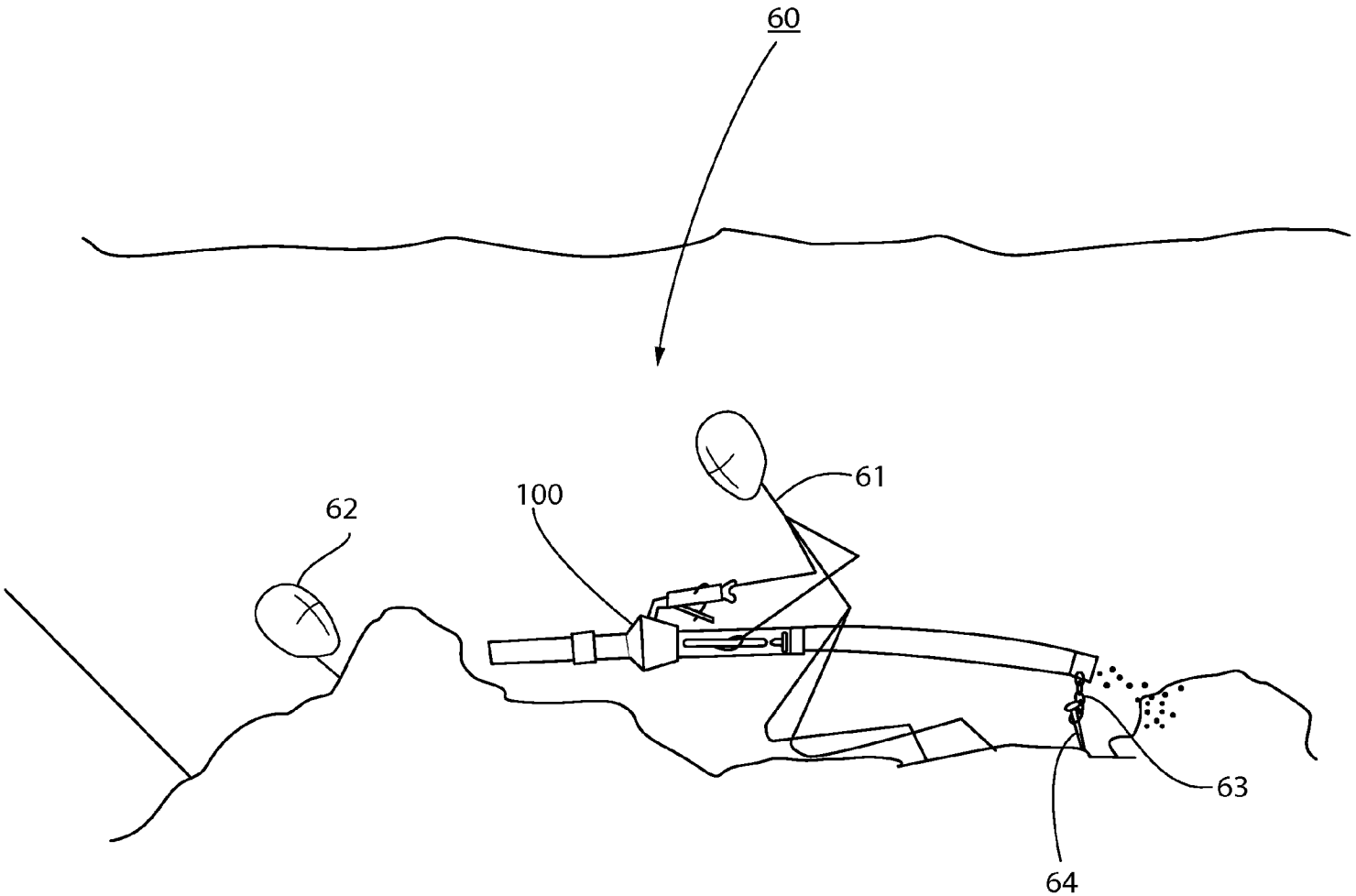
FIG. 24 is a schematic view of another pass-through vacuum system in accordance with an embodiment of the present invention.

FIG. 24 shows an alternate use 60 of the pass-through vacuum apparatus 100 detailed in FIG. 3. An operator 61 trained in the specialty of trench rescue uses the pass-through vacuum 100 to quickly remove spoil entrapping a victim 62. A shortened inlet tube 12 and flexible hose 15 serve to collect and transmit the spoil only a short distance away. The discharge end of the flexible hose may be restrained from whipping with a chain 63 and a ground stake 64. A pass-through vacuum 100 is especially useful in this situation in that it can be run initially from a high pressure bottle cascade typically carried on fire rescue vehicles or from a common portable gas compressor that can be quickly located and brought to the accident scene. This avoids having to wait for a municipal vacuum truck to arrive, which must also be kept well clear of a trench cave-in site due to its large weight and its vibration when operating.

Figure 25:
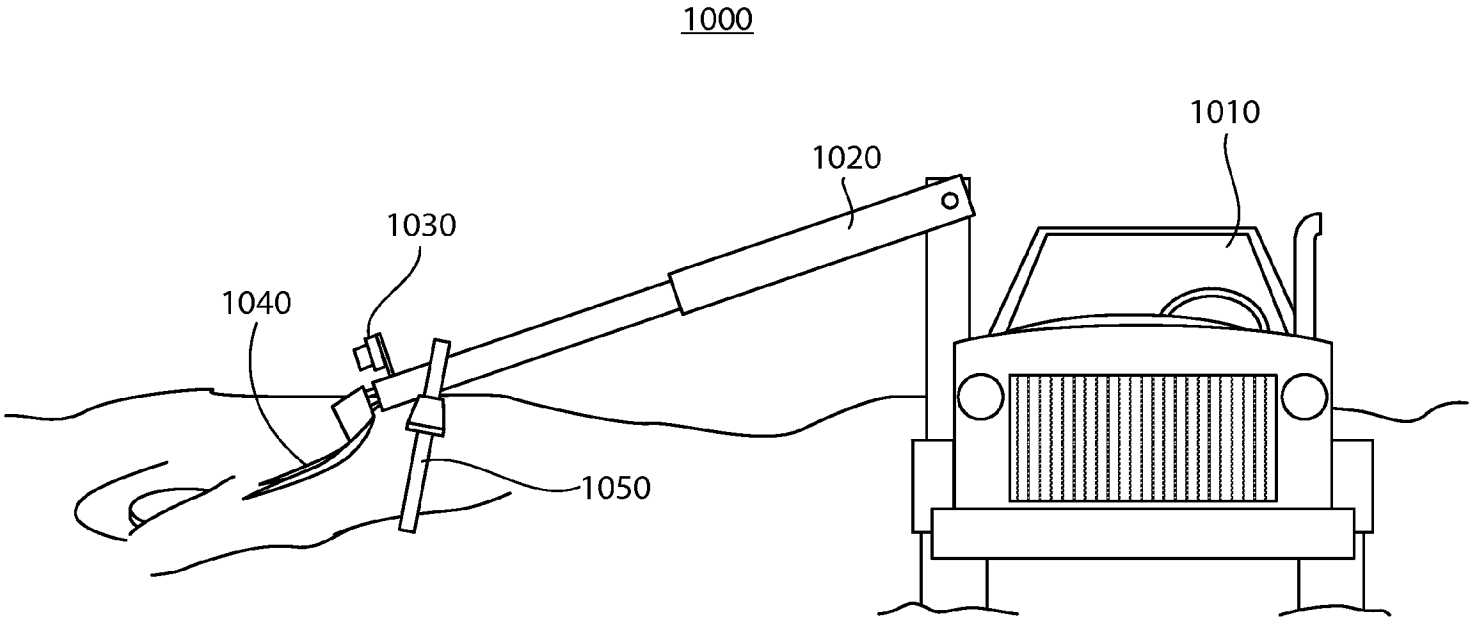
FIG. 25 is a schematic view of another pass-through vacuum in accordance with another embodiment of the present invention.
Figure 29:
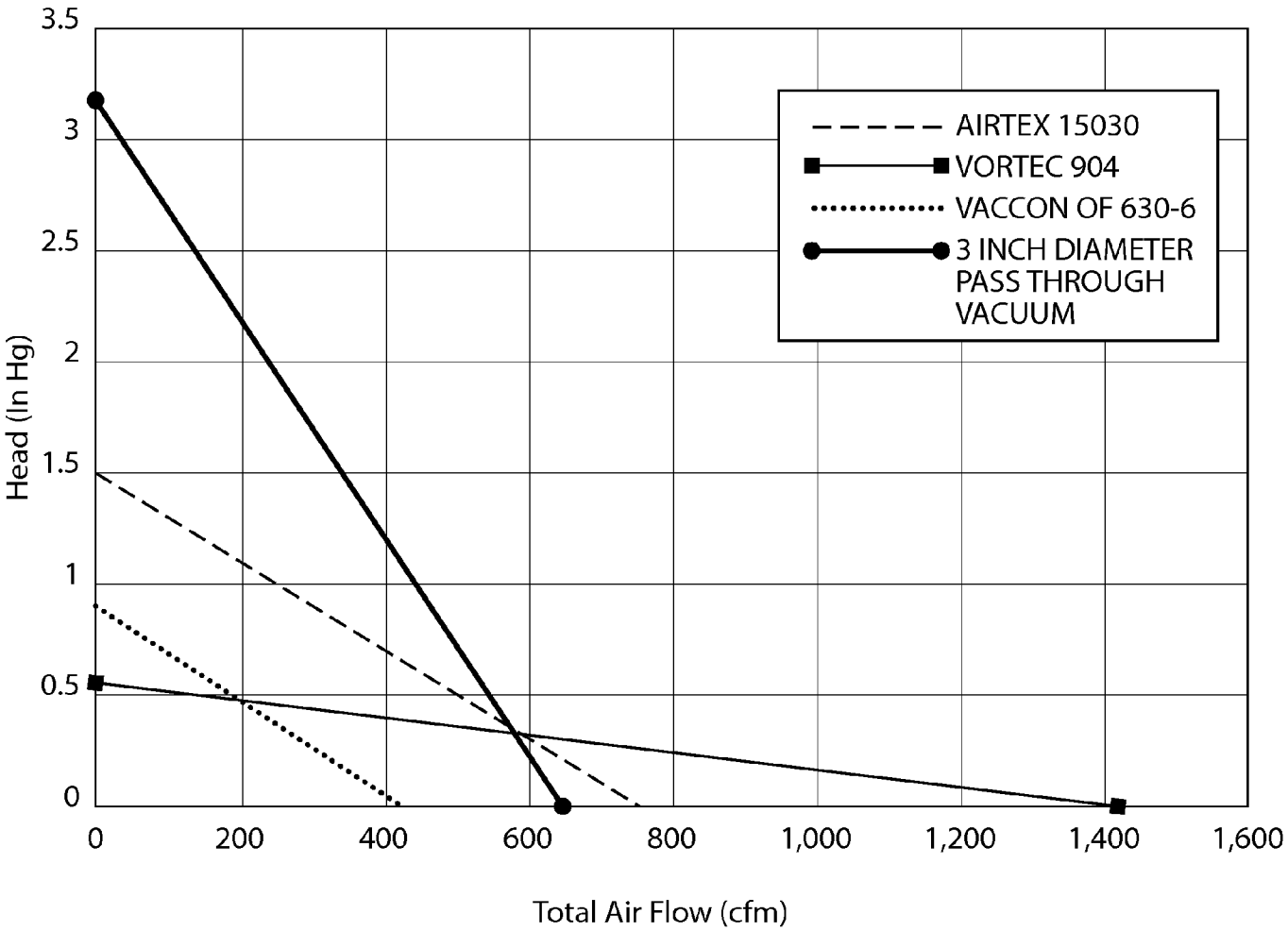
FIG. 29 is a comparison of performance curves for various available air amplifiers.

FIG. 25 depicts another system 1000 of a pass-through vacuum 1050 to uncover buried improvised explosive devices, IED's. FIG. 29 shows a typical, explosion hardened military vehicle 1010 that has a crane 1020 mounted on its front bumper. This crane extends away from the vehicle for investigating a suspected TED. Typically, an operator inside of the vehicle watching a picture from a boom mounted camera 1030 along with using his own vision out of the vehicle's front window maneuvers a spork 1040 on the end of the crane. The spork 1040 has limited ability to dig or uncover buried objects. The operator can use a pass-through vacuum 1050 in conjunction with a gas or gas/water powered digging device mounted on the end of the boom to uncover and investigate buried objects. The pass-through vacuum 1050 is mounted on the crane's boom in a manner such that it can be brought to the ground surface when needed and stored out of the way when not in use. A hydraulically driven gas compressor on-board the vehicle would provide the compressed gas to run the vacuum. As spoil can be directed off to the side of the vehicle, no or only a short length of discharge hose is needed.

With reference to FIGS. 1-25 a method of collecting a flowable material 16 using a pass-through vacuum system 10, according to an embodiment includes the step of providing a pass-through vacuum system 10, made in accordance with the embodiments described above with reference to FIGS. 1-25. Compressed gas is directed from the compressed gas source 18 to the at least one nozzle 112 and is accelerated with the at least one nozzle 112 as the gas enters the hollow interior 108 of the mixing tube 101 via the at least one supersonic nozzle 112 and the aperture 110. Entrained gas 17 flows through the vacuum system 10, from the entrance end 103 of the mixing tube 12 to its exit end 104. Flowable material 16 located proximate to the entrance end 13 of the inlet vacuum tube 12 is entrained in the gas flow 17 and is transmitted through a hose 15 to be collected within a spoils bag 30 or collector 19 or simply a spoils pile at the end of a discharge hose extending from the exit end 104 of the pass-through vacuum 100. The flow of compressed gas from the compressed gas source 18 to the at least one supersonic nozzle 112 and the mixing tube 101 may be regulated with the control valve 122.

With reference to FIGS. 10 and 26-29, it is to be appreciated that the nozzle 112 includes a contoured surface 140 configured to accelerate a flow of compressed gas, such as air, from the compressed gas source 18. According to an embodiment of the present invention, the nozzle 112 is specifically contoured to accelerate the compressed gas to a supersonic velocity, i.e., the nozzle 112 is a supersonic nozzle. As will be discussed in further detail below, the use of a supersonic nozzle can improve the overall performance of the vacuum apparatus according to any one of the several embodiments discussed above.

The theoretical performance of the mixing tube alone may be simply modeled by the following head-flow equation (See FIG. 26):

$$\Delta P=\rho*Q*(Vjet*\cos(\theta)-Vi-Ve)/(\pi*D^2/4)$$

Where $\Delta P$=Injector pressure rise $\rho$=Standard air density

Q=Compressed air standard volume flow rate

Vjet=Exit veloeity of the air jet $\theta$=angle between jet and tube axes

Vi=tube inlet air velocity

Ve=tube exit air velocity

D=inside diameter of tube

Several items are readily seen from the above equation. First, by using a properly designed supersonic nozzle, as stated above, air can be expanded at 90 psig and 100° F. into a Mach 2 jet moving at 1700 feet per second; while a sonic jet from this same pressure and temperature only attains a velocity of 1060 feet per second. Thus, Vj is 60% larger for a supersonic versus a sonic jet producing a significantly higher pressure rise. Second, it is desirable to keep $\theta$ as small as physically possible to have the $\cos(\theta)$ term be close to 1. Third, the pressure rise is directly proportional to the amount of compressed air Q provided. Finally, it is important to note that the pressure rise is inversely proportional to the area of the mixing tube. As the tube inside diameter increases, more compressed air flow is needed to achieve the same level of pressure rise. Note the length of mixing tube L, is measured after point of introduction of supersonic air. Table 1 shows some typical performance calculations for pass through vacuums of various diameters. Table 2 shows how the performance of a pass-through vacuum of a given size changes with the volume of compressed air used.

TABLE 1

Calculated Performance of Pass-through Vacuums

| Tube Diameter (in) | Input Air (scfm) at 90 psig | Dead Head (in Hg) | Peak Flow (fpm) |
|---|---|---|---|
| 2 | 75 | 3.6 | 10,300 |
| 3 | 150 | 3.1 | 10,100 |
| 4 | 300 | 3.4 | 10,800 |

TABLE 2

Calculated Performance of 3 inch Pass-through Vacuum

| Tube Diameter (in) | Input Air (scfm) at 90 psig | Dead Head (in Hg) | Peak Flow (fpm) |
|---|---|---|---|
| 3 | 100 | 2.0 | 8,700 |
| 3 | 150 | 3.1 | 10,100 |
| 3 | 225 | 4.5 | 11,700 |

Figure 27A:
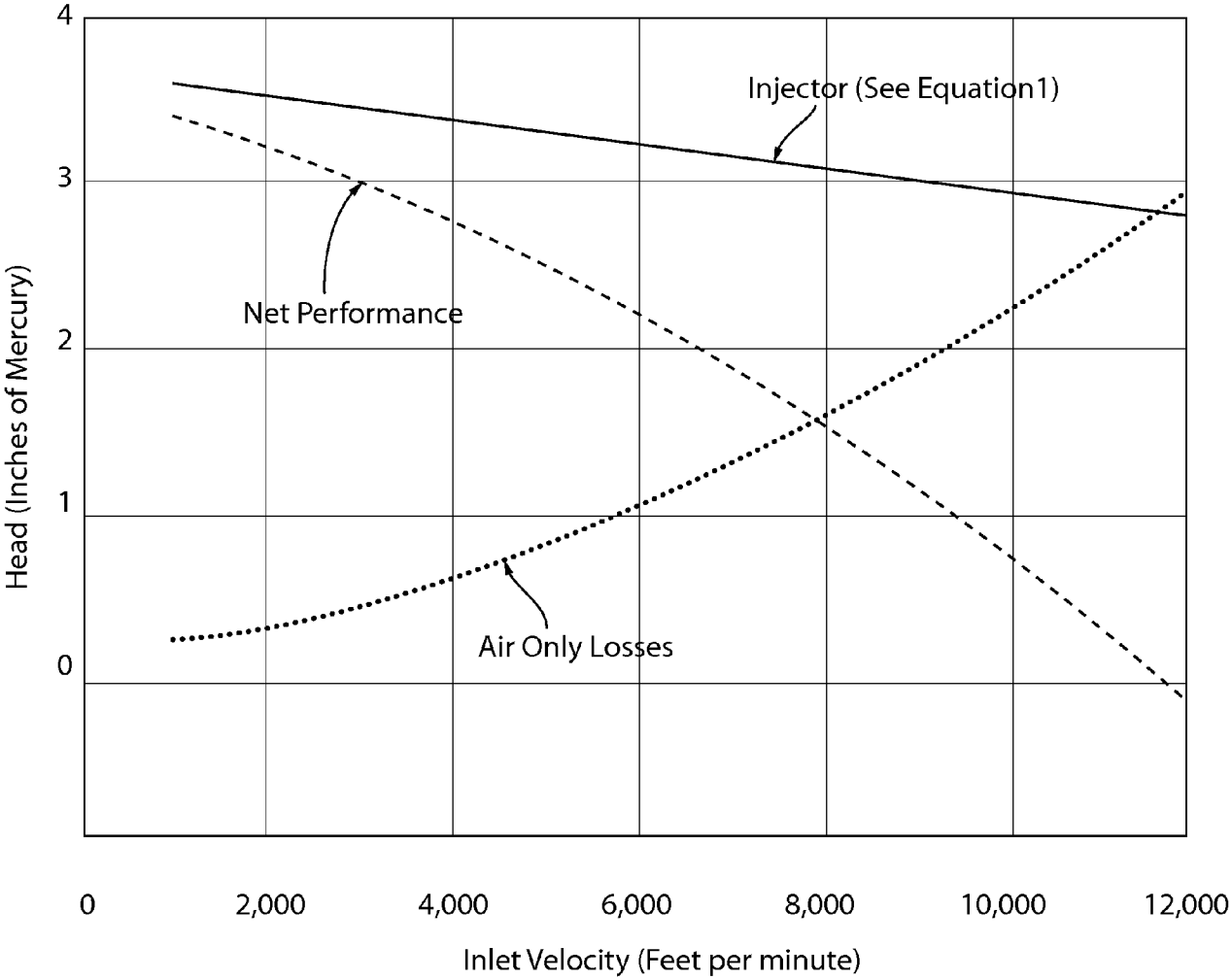
FIG. 27A is a graph of the performance of the injector flowing air only.
Figure 27B:
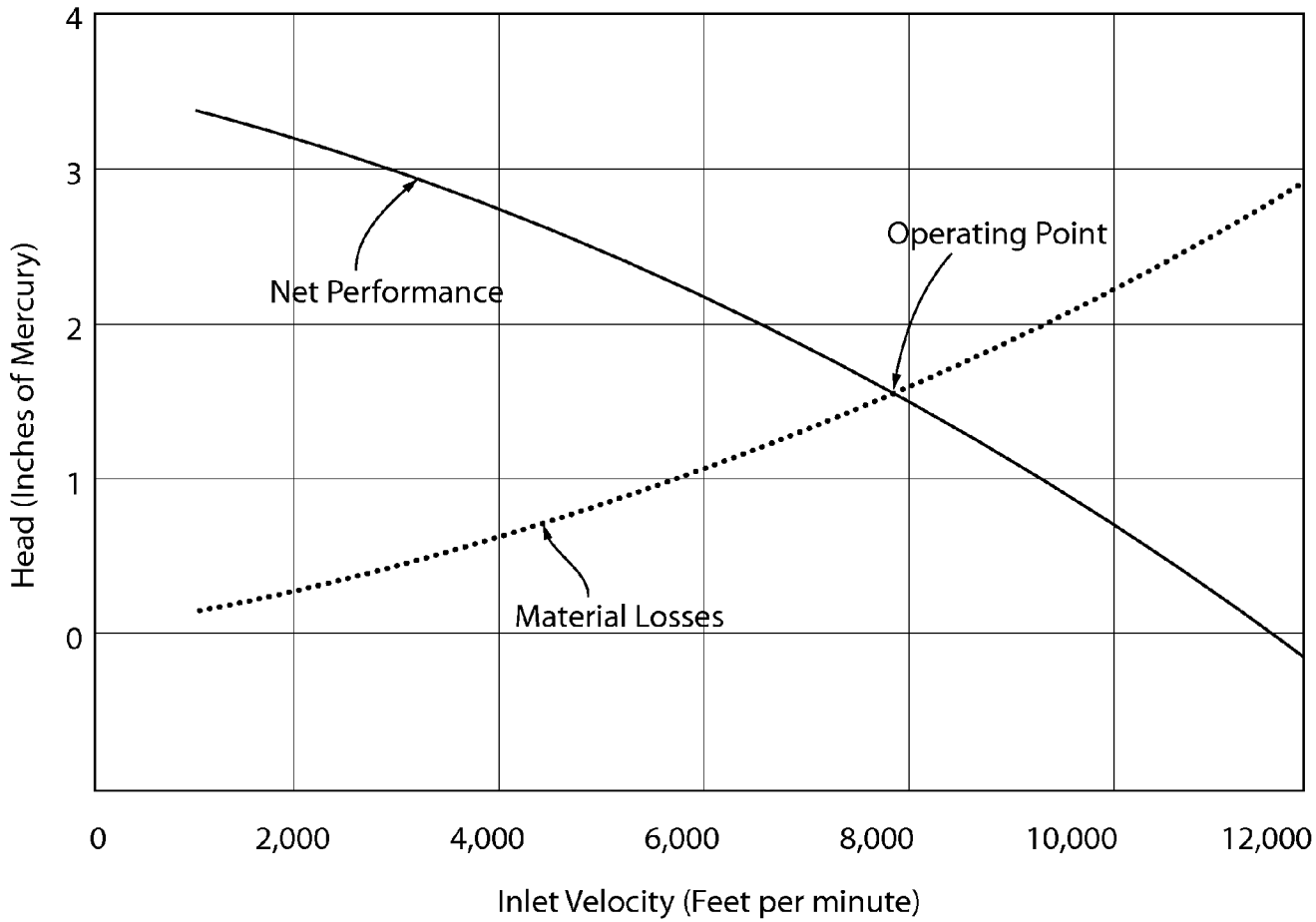
FIG. 27B is a second graph of the performance of the pass through vacuum with material.

When a pass-through vacuum is in use, the actual operating point is determined by the intersection of the above injector head-flow curve and the system loss curve. Losses include: friction of the air moving through the lengths of hose and tube; inlet contraction and exit expansion of the air; raising of the material against gravity; and acceleration of the material through the lengths of tube and hose and around any curves in the hose. FIG. 27A shows a typical injector head flow curve from equation (1), the air loss only curve, and the resulting available head curve to move material. FIG. 27B illustrates a typical system operating point where the available head curve and the material loss curve intersect. The pass-through vacuums operate in dilute phase flow, as do the majority of pneumatic conveying systems.

Figure 28:
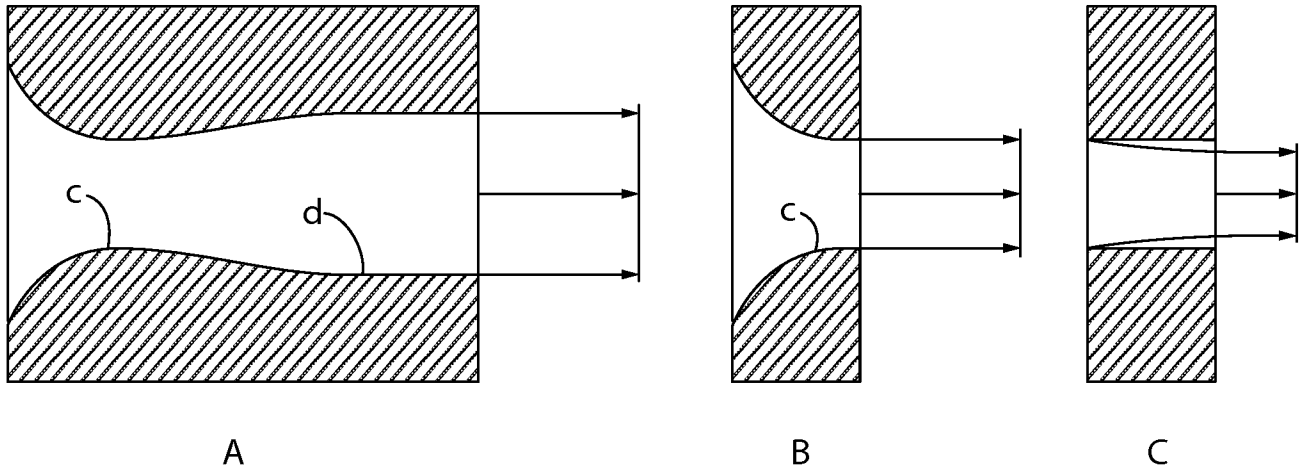
FIG. 28 is a comparison of various nozzle profiles.

FIG. 28 illustrates the important differences between various nozzle types used in pass through vacuums. FIG. 28A shows the cross-section of a supersonic nozzle as used in the disclosed pass-through vacuum. The nozzle includes an interior surface that contains a converging section c, followed by a diverging section d. A supersonic nozzle having such a contoured surface for producing a supersonic jet by accelerating compressed air is disclosed in U.S. Pat. No. 5,782,414 to Nathenson, which is hereby incorporated by reference as if set forth in its entirety herein. As discussed above, air entering the nozzle entrance on the left at 90 psig and 100° F. is accelerated to exit uniformly and parallel to the nozzle axis as shown at approximately 1700 feet per second. FIG. 28B illustrates a nozzle containing only the smoothly converging section c. For the same inlet pressure and temperature, the flow chokes at the minimum diameter exit achieving only sonic velocity of about 1060 feet per second. FIG. 28C shows a sharp edged orifice as would represent a simple drilled hole. Air flowing through such a nozzle contracts, resulting in only about 67% as much air flow rate as the converging nozzle for similar inlet conditions. Since from the injector performance equation discussed above, the head depends on the input flow Q, and the jet velocity Vjet, the superiority of the supersonic nozzle is clearly seen.

FIG. 29 shows a comparison of performance curves for various commercially available, 3 inch throat air amplifiers versus the improved pass-through vacuum disclosed herein utilizing a supersonic nozzle. A 3 inch diameter vacuum tube is a good selection for moving soil as it can be powered from a 175 scfm portable air compressor, which is the most common size available in industry. The superior head produced by the improved pass-through vacuum is evident.

While embodiments of a pass-through vacuum system were provided in the foregoing description, those skilled in the art may make modifications and alterations to these embodiments without departing from the scope and spirit of the invention. Accordingly, the foregoing description is intended to be illustrative rather than restrictive. The invention described hereinabove is defined by the appended claims and all changes to the invention that fall within the meaning and the range of equivalency of the claims are to be embraced within their scope. It is to be understood that the present invention contemplates that, to the extent possible, one or more features of any embodiment can be combined with one or more features of any other embodiment.

The invention claimed is:

1. A pass-through vacuum, comprising:

a mixing tube extending along a central longitudinal axis between an entrance end and an exit end, the mixing tube including a tube wall having an inner cylindrical surface defining a hollow interior of the mixing tube and an outer surface defining a periphery of the mixing tube and at least one aperture extending through the tube wall from the outer surface to the inner cylindrical surface of the tube wall;

a housing removably disposed on the periphery of the mixing tube and connected to the outer surface of the mixing tube by a connector; and at least one nozzle disposed within the housing, the at least one nozzle extending along a nozzle axis and having an inlet configured to be in fluid communication with a compressed gas source and an outlet in fluid communication with the hollow interior of the mixing tube via the at least one aperture in the mixing tube wall, wherein the housing retains the at least one nozzle proximate to the periphery of the mixing tube and aligns the outlet of the at least one nozzle with the at least one aperture in the mixing tube wall, wherein the nozzle axis of the at least one nozzle extends at an acute angle with respect to the central longitudinal axis of the mixing tube, and wherein the at least one nozzle is configured to accelerate gas from the compressed gas source as the gas enters the hollow interior of the mixing tube via the at least one nozzle and the aperture to create an entrained gas flow through the mixing tube from the entrance end to the exit end.

2. The pass-through vacuum according to claim 1, wherein the acute angle of nozzle axis is approximately 5°-20°.

3. The pass-through vacuum according to claim 1, wherein the at least one nozzle is a supersonic nozzle.

4. The pass-through vacuum according to claim 1, wherein the housing comprises an external tube surrounding the periphery of the mixing tube and at least one housing tube attached to the external tube and extending along the nozzle axis away from the periphery of the mixing tube, the at least one nozzle is retained within the at least one housing tube, and the external tube is connected to the outer surface of the mixing tube such that the at least one housing tube is aligned with the at least one aperture in the mixing tube wall.

5. The pass-through vacuum according to claim 4, wherein the at least one housing tube is constructed of a thick wall metal tube.

6. The pass-through vacuum according to claim 1, wherein the housing comprises a vacuum head surrounding the periphery of the mixing tube and at least one housing tube defined within the vacuum head and extending along the nozzle axis away from the periphery of the mixing tube, the at least one nozzle is retained within the at least one housing tube of the vacuum head, and the vacuum head is connected to the outer surface of the mixing tube such that the at least one housing tube is aligned with the at least one aperture in the mixing tube wall.

7. The pass-through vacuum according to claim 1, wherein the at least one nozzle comprises a plurality of nozzles, the housing further comprises a plurality of housing tubes for retaining the plurality of nozzles and a manifold having an inlet configured to be connected to the compressed gas source and a plurality of outlets in fluid communication with the plurality of housing tubes and the inlets of the nozzles, and the manifold is configured to direct compressed gas from the inlet of the manifold to the plurality of nozzles.

8. The pass-through vacuum according to claim 7, wherein the manifold is constructed from pipe and at least partially surrounds the periphery of the mixing tube.

9. The pass-through vacuum according to claim 7, wherein the manifold is a hollow toroidal ring constructed from pipe and encircling the periphery of the mixing tube.

10. The pass-through vacuum according to claim 7, wherein the housing comprises a vacuum head and the manifold is a circumferential cavity defined in the vacuum head.

11. The pass-through vacuum according to claim 7, further comprising a mechanism for selectively closing off flow of compressed gas from the manifold to the inlet of at least one of the plurality of nozzles.

12. The pass-through vacuum according to claim 11, wherein the mechanism comprises a body that engages the housing and a sealing element disposed on an end of the body, and the body of the mechanism extends at least partially through the manifold to engage the inlet of the at least one of the plurality of nozzles with the sealing element to close off the flow of compressed gas to the inlet of the at least one of the plurality of nozzles.

13. The pass-through vacuum according to claim 1, further comprising a control valve in fluid communication with the inlet of the at least one nozzle and configured to regulate a flow of compressed gas from the compressed gas source to the at least one nozzle and the mixing tube.

14. The pass-through vacuum according to claim 1, further comprising sealing elements disposed between the housing and the outer surface of the mixing tube, wherein the sealing elements seal the attachment between the housing and the outer surface of the mixing tube and the at least one aperture in the mixing tube is disposed between at least two sealing elements.

15. The pass-through vacuum according to claim 1, wherein the outlet of the at least one nozzle is spaced from the hollow interior of the mixing tube by a minimal distance.

16. The pass-through vacuum according to claim 1, further comprising at least one handle disposed on the outer surface of the mixing tube.

17. The pass-through vacuum according to claim 1, wherein the at least one nozzle is made from a material chosen from the group consisting of: brass, stainless steel, aluminum, plastic, and reinforced plastic.

18. The pass-through vacuum according to claim 1, wherein the mixing tube is made from a material chosen from the group consisting of hardened carbon steel, UHMW plastic, polyvinyl chloride, polyurethane, fiberglass epoxy, brass, stainless steel, aluminum, plastic, iron, polytetrafluoroethylene, and combinations thereof.

19. The pass-through vacuum according to claim 1, wherein a ratio of a length of the mixing tube between a centerline of the at least one aperture and the exit end of the mixing tube to an inside diameter of the mixing tube is 7 to 8.

20. The pass-through vacuum according to claim 1, wherein the compressed gas is air.

21. A pass-through vacuum system, comprising:

an inlet vacuum tube having an entrance end and an exit end, the entrance end of the inlet vacuum tube being configured to collect a flowable material; and a pass-through vacuum, comprising:

a mixing tube extending along a central longitudinal axis between an entrance end and an exit end, the mixing tube including a tube wall having an inner cylindrical surface defining a hollow interior of the mixing tube and an outer surface defining a periphery of the mixing tube and at least one aperture extending through the tube wall from the outer surface to the inner cylindrical surface of the tube wall;

a housing removably disposed on the periphery of the mixing tube and connected to the outer surface of the mixing tube by a connector; and at least one nozzle disposed within the housing, the at least one nozzle extending along a nozzle axis and having an inlet configured to be in fluid communication with a compressed gas source and an outlet in fluid communication with the hollow interior of the mixing tube via the at least one aperture in the mixing tube wall, wherein the entrance end of the mixing tube is in fluid communication with the exit end of the inlet vacuum tube, wherein the housing retains the at least one nozzle proximate to the periphery of the mixing tube and aligns the outlet of the at least one nozzle with the at least one aperture in the mixing tube wall, wherein the nozzle axis of the at least one nozzle extends at an acute angle with respect to the central longitudinal axis of the mixing tube, and wherein the at least one nozzle is configured to accelerate gas from the compressed gas source as the gas enters the hollow interior of the mixing tube via the at least one nozzle and the aperture to create an entrained gas flow through the vacuum system from the entrance end of the inlet vacuum tube through the exit end of the mixing tube for entraining the flowable material proximate to the entrance end of the inlet vacuum tube.

22. The pass-through vacuum system according to claim 21, further comprising a flexible conduit in fluid communication with the inlet vacuum tube and the mixing tube.

23. The pass-through vacuum system according to claim 22, wherein the flexible conduit is connected to the exit end of the mixing tube, the flexible conduit being configured to direct the entrained flowable material from the exit end of the mixing tube.

24. The pass-through vacuum system according to claim 22, wherein the flexible conduit is connected between the exit end of the inlet vacuum tube and the entrance end of the mixing tube, the flexible conduit being configured to direct the entrained flowable material from the inlet vacuum tube to the mixing tube.

25. The pass-through vacuum system according to claim 22, wherein the flexible conduit is made from a clear material.

26. The pass-through vacuum system according to claim 22, wherein the flexible conduit includes fittings for connecting the flexible conduit to the inlet vacuum tube or the mixing tube or both.

27. The pass-through vacuum system according to claim 22, wherein the flexible conduit is connected to a mechanism for securing the flexible conduit from whipping.

28. The pass-through vacuum system according to claim 21, wherein the exit end of the mixing tube is in fluid communication with a collector configured to receive and contain the entrained flowable material while allowing the entrained gas flow to escape.

29. The pass-through vacuum system according to claim 28, wherein the exit end of the mixing tube is in fluid communication with the collector via a flexible conduit.

30. The pass-through vacuum system according to claim 28, wherein the collector is a flexible bag.

31. The pass-through vacuum system according to claim 28, wherein the collector is a rigid container.

32. The pass-through vacuum system according to claim 31, wherein the rigid container incorporates a filter for removing entrained flowable material from the entrained gas flow.

33. The pass-through vacuum system according to claim 21, wherein the inlet vacuum tube is made from a clear material.

34. The pass-through vacuum system according to claim 21, wherein connection fittings are disposed on the inlet vacuum tube or the mixing tube or both.

35. The pass-through vacuum system according to claim 21, wherein the compressed gas source comprises an air compressor.

36. The pass-through vacuum system according to claim 21, further comprising a water suction adapter disposed on the entrance end of the inlet vacuum tube.

37. The pass-through vacuum system according to claim 21, further comprising at least one handle disposed on the outer surface of the mixing tube.

38. The pass-through vacuum system according to claim 21, further comprising a control valve in fluid communication with the inlet of the at least one nozzle and configured to regulate a flow of compressed gas from the compressed gas source to the at least one supersonic nozzle and the mixing tube.

39. The pass-through vacuum system according to claim 21, wherein the at least one nozzle is a supersonic nozzle.

40. A method of directing a flowable material, comprising the steps of:

providing a pass-through vacuum system comprising:

an inlet vacuum tube having an entrance end and an exit end, the entrance end of the inlet vacuum tube being configured to collect a flowable material; and a pass-through vacuum, comprising:

a mixing tube extending along a central longitudinal axis between an entrance end and an exit end, the mixing tube including a tube wall having an inner cylindrical surface defining a hollow interior of the mixing tube and an outer surface defining a periphery of the mixing tube and at least one aperture extending through the tube wall from the outer surface to the inner cylindrical surface of the tube wall;

a housing removably disposed on the periphery of the mixing tube and connected to the outer surface of the mixing tube by a connector; and at least one nozzle disposed within the housing, the at least one nozzle extending along a nozzle axis and having an inlet configured to be in fluid communication with a compressed gas source and an outlet in fluid communication with the hollow interior of the mixing tube via the at least one aperture in the mixing tube wall, wherein the entrance end of the mixing tube is in fluid communication with the exit end of the inlet vacuum tube, wherein the housing retains the at least one nozzle proximate to the periphery of the mixing tube and aligns the outlet of the at least one nozzle with the at least one aperture in the mixing tube wall, wherein the nozzle axis of the at least one nozzle extends at an acute angle with respect to the central longitudinal axis of the mixing tube;

directing compressed gas from the compressed gas source to the at least one nozzle;

accelerating the compressed gas with the at least one nozzle as the gas enters the hollow interior of the mixing tube via the at least one nozzle and the aperture;

creating an entrained gas flow through the vacuum system from the entrance end of the inlet vacuum tube through the exit end of the mixing tube;

entraining the flowable material proximate to the entrance end of the inlet vacuum tube in the entrained air flow; and directing the flowable material out of the exit end of the mixing tube.

41. The method according to claim 40, wherein the directing step includes directing the flowable material to a collector in fluid communication with the exit end of the mixing tube and collecting the flowable material with the collector.

42. The method according to claim 40, wherein the system further includes a flexible conduit in fluid communication with the inlet vacuum tube and the mixing tube.

43. The method according to claim 40, wherein the compressed gas source comprises an air compressor.

44. The method according to claim 40, wherein the at least one nozzle is a supersonic nozzle.

45. The method according to claim 40, wherein the system further includes a water suction adapter disposed on the entrance end of the inlet vacuum tube and the flowable material comprises water.

46. The method according to claim 45, wherein the flowable material comprises oil and water.

47. The method according to claim 45, wherein the system is provided on a boat.

48. The method according to claim 45, wherein the flowable material is contained in a valve box prior to being entrained.

49. The method according to claim 40, wherein the system is provided on a boom extending from a vehicle and the flowable material covers an explosive device.

50. A suction adapter disposed on an end of a vacuum tube for entraining liquid material in a gas flow, the suction adapter comprising:

an outer piece attached to the end of the vacuum tube; and an inner piece partially disposed within and connected to the outer piece such that an annular space is formed between the inner piece and the outer piece, wherein the inner piece has a longer length and a smaller diameter than the outer piece, and wherein the outer piece and the inner piece are both in fluid communication with the end of the vacuum tube, the outer piece is also in fluid communication with atmosphere, and gas may flow through the annular space between the inner piece and the outer piece while the inner piece is at least partially submerged in the liquid to entrain the liquid in the gas flow.

51. The suction adapter according to claim 50, wherein the inner piece is connected to the outer piece by fasteners.

52. A pass-through vacuum, comprising:

a mixing tube extending along a central longitudinal axis between an entrance end and an exit end, the mixing tube including a tube wall having an inner cylindrical surface defining a hollow interior of the mixing tube and an outer surface defining a periphery of the mixing tube and a plurality of apertures extending through the tube wall from the outer surface to the inner cylindrical surface of the tube wall;

a plurality of nozzles, each nozzle extending along a nozzle axis and having an inlet configured to be in fluid communication with a compressed gas source and an outlet in fluid communication with the hollow interior of the mixing tube via one of the plurality of apertures;

a housing disposed on the periphery of the mixing tube and connected to the outer surface of the mixing tube, the housing including plurality of housing tubes for retaining the plurality of nozzles and a manifold having an inlet configured to be connected to the compressed gas source and a plurality of outlets in fluid communication with the plurality of housing tubes and the inlets of the nozzles; and a mechanism for selectively closing off flow of compressed gas from the manifold to the inlet of at least one of the plurality of nozzles, wherein the housing retains the plurality of nozzles proximate to the periphery of the mixing tube and aligns the outlets of the nozzles with the apertures in the mixing tube wall, wherein each nozzle axis extends at an acute angle with respect to the central longitudinal axis of the mixing tube, wherein the manifold is configured to direct compressed gas from the inlet of the manifold to the plurality of nozzles, and wherein the nozzles are configured to accelerate gas from the compressed gas source as the gas enters the hollow interior of the mixing tube via the nozzles and the apertures to create an entrained gas flow through the mixing tube from the entrance end to the exit end.

53. The pass-through vacuum according to claim 52, wherein the mechanism for comprises a body that engages the housing and a sealing element disposed on an end of the body, and the body of the mechanism extends at least partially through the manifold to engage the inlet of the at least one of the plurality of nozzles with the sealing element to close off the flow of compressed gas to the inlet of the at least one of the plurality of nozzles.

* * * * *